US006314261B1

(12) United States Patent
Omata et al.

(10) Patent No.: US 6,314,261 B1
(45) Date of Patent: Nov. 6, 2001

(54) TONER CONTAINER AND TONER REPLENISHING MECHANISM

(75) Inventors: Kazuhiko Omata, Shizuoka-ken; Yusuke Yamada, Numazu; Katsuya Murakami, Yokohama; Fumio Tazawa, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/523,311

(22) Filed: Mar. 10, 2000

(30) Foreign Application Priority Data

Mar. 17, 1999 (JP) ..... 11-072147
Dec. 28, 1999 (JP) ..... 11-374051

(51) Int. Cl.[7] ..... G03G 15/08

(52) U.S. Cl. ..... 399/258; 399/120; 399/261; 222/DIG. 1

(58) Field of Search ..... 222/DIG. 1, 167; 399/120, 258, 259, 260, 261, 262, 263

(56) References Cited

FOREIGN PATENT DOCUMENTS 2-293770 * 12/1990 (JP) .
07-020705 1/1995 (JP) .
10-260574 9/1998 (JP) .
10-339993 * 12/1998 (JP) .

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

A toner container for containing toner has a container main body portion, a container end portion, an aperture portion, and an extendable portion connecting the container main body portion and the container end portion. The extendable portion renders the portion capable of a relative rocking motion. The toner is discharged from the aperture portion by the relative rocking motion of the container main body portion and the container end portion.

23 Claims, 21 Drawing Sheets

TONER CONTAINER AND TONER REPLENISHING MECHANISM

BACKGROUND OF THE INVENTION

1. Field of the Invention

The present invention relates to a toner container adapted for toner replenishment to a developing device of an image forming apparatus such as a copying machine, a facsimile printer or the like, and a toner replenishing mechanism employing such toner container.

2. Related Background Art

As a means of toner replenishment from a toner container to a developing device provided in the main body of an electrophotographic image forming apparatus, there is conventionally known a system of setting, at the toner replenishing operation, a toner container in a toner storage unit of the developing device, then transferring the entire toner at a time from the toner container to the toner storage unit and detaching the toner container from the main body after the replenishing operation.

Such system is however unsatisfactory in its operation property, for example because of smearing the toner caused by over-feeding of the toner, since the entire amount of the toner is replenished at one time.

In order to resolve the above-mentioned drawback, the Japanese Patent Application Laid-Open Nos. 7-020705 and 10-260574 proposed a toner container and a toner replenishing device in which a cylinder having a spiral portion on the periphery thereof is rotated about the axis thereof in a substantially horizontal position to discharge and supply the toner to the developing device in small portions.

The proposal described in the Japanese Patent Application Laid-Open Nos. 7-020705 and 10-260574 resolves the drawback of smearing caused by the overfeeding of toner, but the above-described system is still associated with a drawback that the stabilization of the toner discharge takes a certain amount of time in case the toner causes bridging in the toner container.

SUMMARY OF THE INVENTION

An object of the present invention is to provide a toner container and a toner replenishing mechanism, capable of preventing smearing the toner, caused by overfeeding thereof, thereby improving the operation property.

Another object of the present invention is to provide a toner container and a toner replenishing mechanism, capable of stabilizing toner discharge from the toner container.

Still other objects of the present invention, and the features thereof, will become fully apparent from the following detailed description, which is to be taken in conjunction with the accompanying drawings.

DETAILED DESCRIPTION OF THE PREFERRED EMBODIMENTS

Now the present invention will be explained in detail by preferred embodiments thereof, with reference to the attached drawings. However, the dimensions, materials, shapes and relative positions of the components described in these embodiments are not to limit the scope of the present invention, unless specifically stated otherwise.

[Electrophotographic Image Forming Apparatus]

Figure 15:
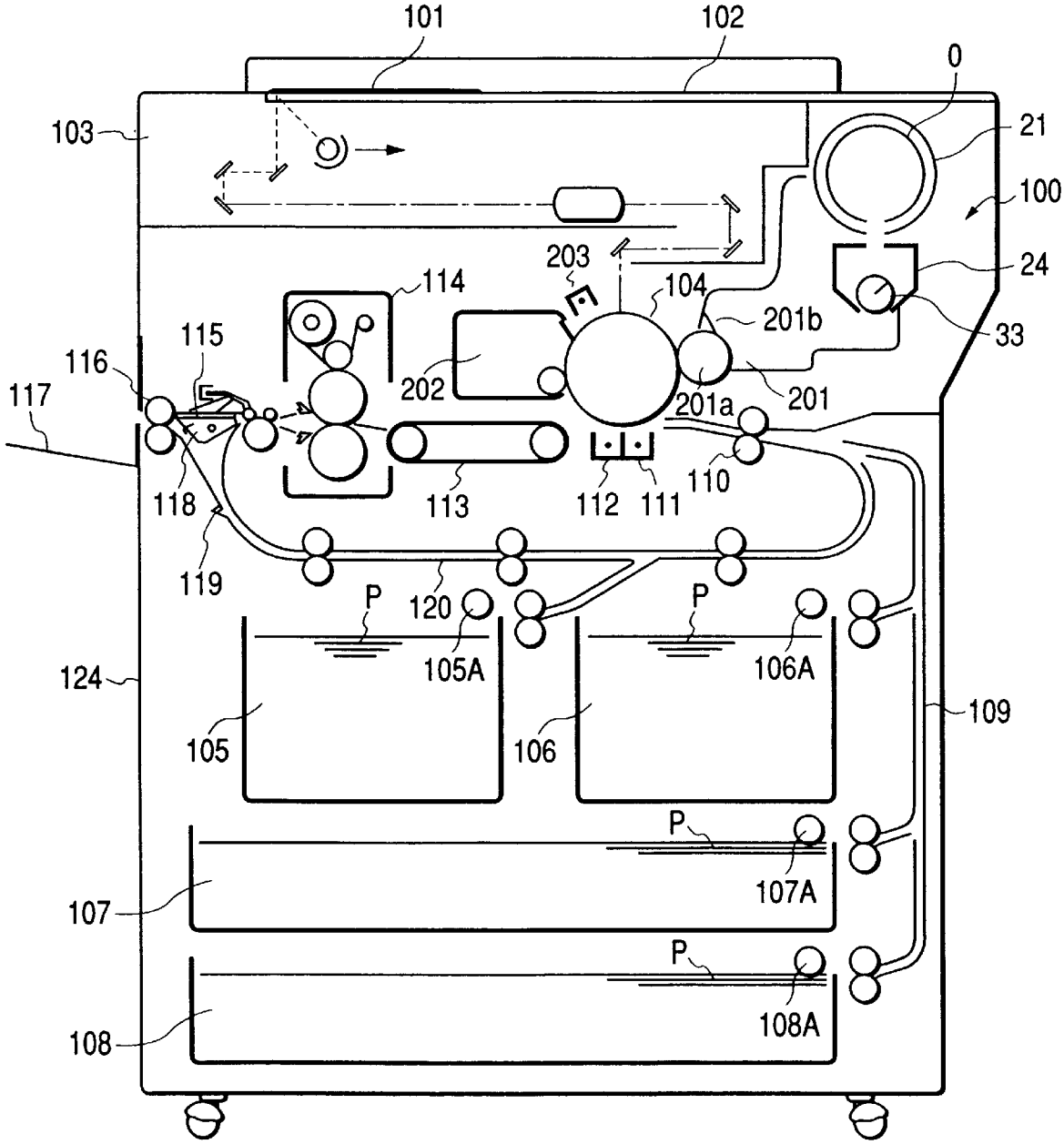
FIG. 15 is a longitudinal cross-sectional view of an image forming apparatus.

FIG. 15 is a longitudinal cross-sectional view of an electrophotographic image forming apparatus provided with a toner replenishing device of the present invention.

An original 101 is placed on an original supporting glass 102, and the information of the original is focused through plural mirrors and lenses of an optical unit 103 onto a photosensitive drum 104. Among sheet feeding cassettes 105 to 108, an appropriate one with paper sheets P of an optimum size is selected from the information entered by the user through an unrepresented operation unit or from the sheet size of the original 101. Then a sheet P, transported by either one of sheet separating units 105A to 108A is conveyed through a conveying unit 109 to registration rollers 110, which further conveys the sheet P in synchronization with the rotation of the photosensitive drum 104 and the timing of scanning operation of the optical unit 103. The sheet P, subjected to the transfer of a toner image from the photosensitive drum 104 and separated therefrom by transfer and separation chargers 111, 112, is conveyed by a conveying unit 113 to a fixing station 114 in which the toner image on the sheet P is fixed by heat and pressure. Thereafter:

1) in case of one-side copying, the sheet P passes a discharge sheet turn-over (reversing) unit 115 and is discharged by sheet discharge rollers 116 onto a sheet discharge tray 117;
2) in case of multiple copying, the sheet P is conveyed, by the control of a flapper 118 in the sheet discharge turn-over unit 115, through sheet re-feeding paths 119, 120 to the registration rollers 110. Then the sheet P passes through the image forming unit, conveying unit and fixing station again as explained in the foregoing and is then discharged onto the sheet discharge tray 117;
3) in case of two-side copying, the sheet P passes the sheet discharge turn-over unit 115 and is partly discharged from the apparatus by the sheet discharge rollers 116. The above-mentioned flapper 118 is activated in a state where the trailing end of the sheet P passes through the flapper 118 but is still pinched between the sheet discharge rollers 116, thereby reversing the rotation thereof to convey the sheet P again into the apparatus. The sheet P is then conveyed through the sheet re-feeding paths 119, 120 to the registration rollers 110, and further through the image forming unit, conveying unit and fixing station again as explained in the foregoing and is then discharged onto the sheet discharge tray 117.

In the electrophotographic image forming apparatus of the above-described configuration, around the photosensitive drum 104, there are provided devices such as a developing unit 201, a cleaning unit 202 and a primary charger 203. The developing unit 201 supplies toner onto the photosensitive drum 104 for developing the information of the original 101 formed thereon as an electrostatic latent image through the optical unit 103, and a toner containing unit 0 for replenishing the toner in the developing unit 201 is detachably attachable on a main body 124 of the apparatus.

In the above-described configuration, the developing unit 201 is provided with a developing roller 201*a* which is opposed to the photosensitive drum 104 with a small gap (about 300 $\mu$m) thereto. At the developing operation, a triboelectric charge is given to the toner by a developing blade 201*b*, and a thin toner layer is formed on the developing roller 201*a*, and the latent image on the photosensitive drum 104 is developed by the application of a developing bias voltage to the developing roller 201*a*.

The toner consumed by the development is replenished from the toner replenishing unit 100.

Figure 16:
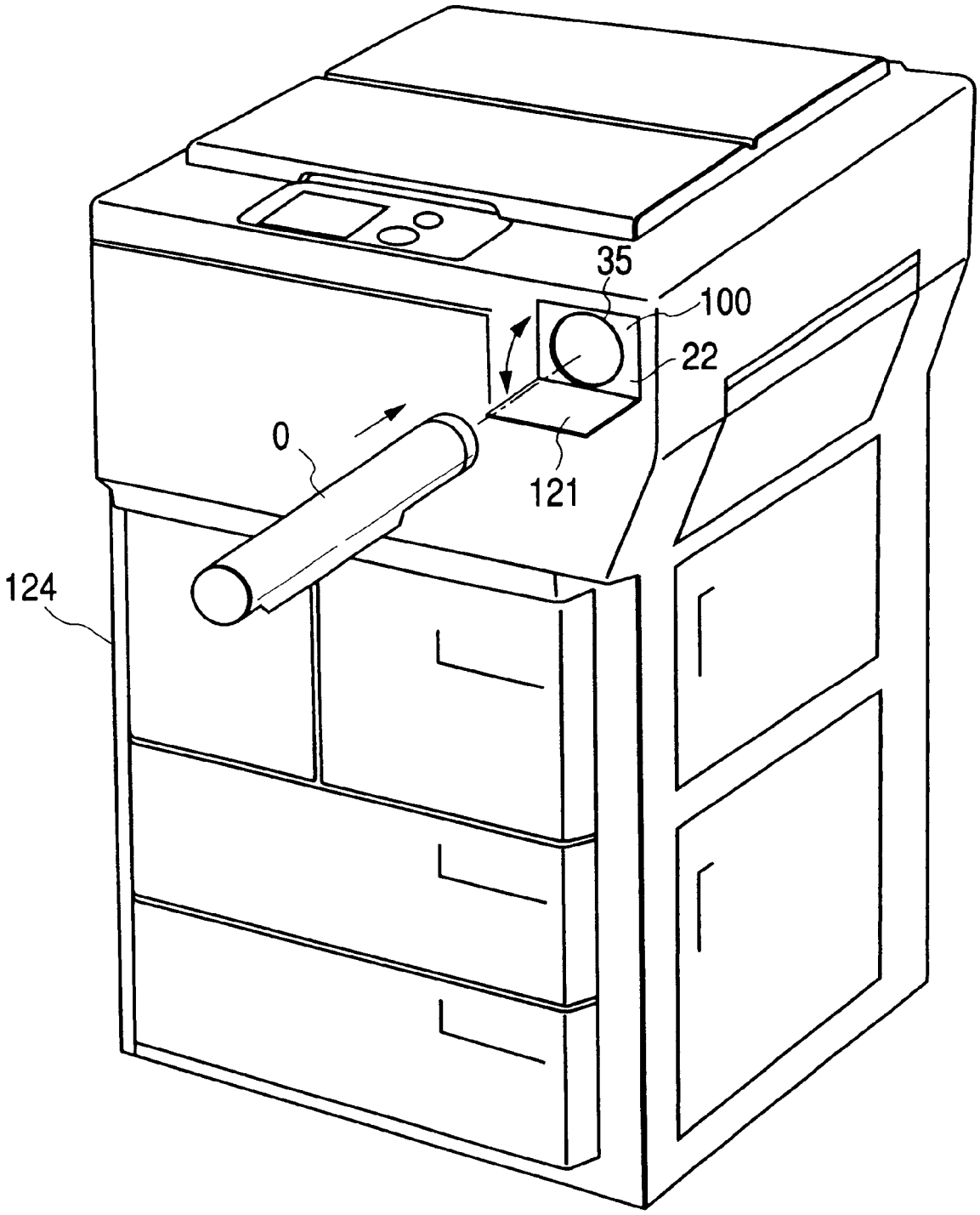
FIG. 16 is a perspective view of an image forming apparatus.

When the toner in the toner replenishing unit 100 is used up, there is opened a door member 121 articulated to the lower edge of an aperture 122, provided at the upper corner of the front face of the main body 124 as shown in FIG. 16, whereby a holder 35 for detachably mounting the toner containing unit 0 becomes exposed. The toner container 0 is inserted into the holder 35, whereby the toner container 0 is guided by guide means provided in the longitudinal direction of the holder 35 and is mounted. The toner container 0 thus inserted is fitted in and supported by a drive unit 21, to be explained later, of the toner replenishing unit 100, whereby the toner is supplied through a developing buffer 24 to the developing unit 201. When the door member 121 is closed, the power switch is turned on to activate the image forming apparatus.

[Toner Container]

Figure 1A:
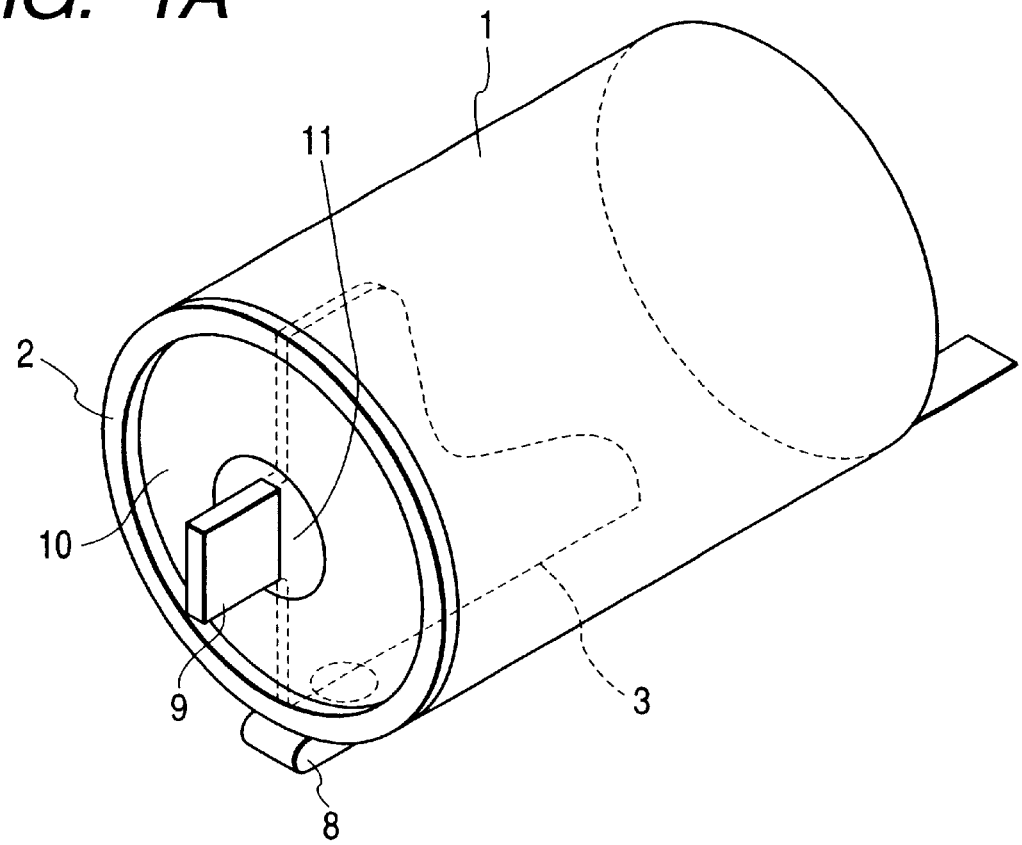
FIGS. 1A and 1B are respectively a perspective view and a longitudinal cross-sectional view of a toner container.
Figure 1B:
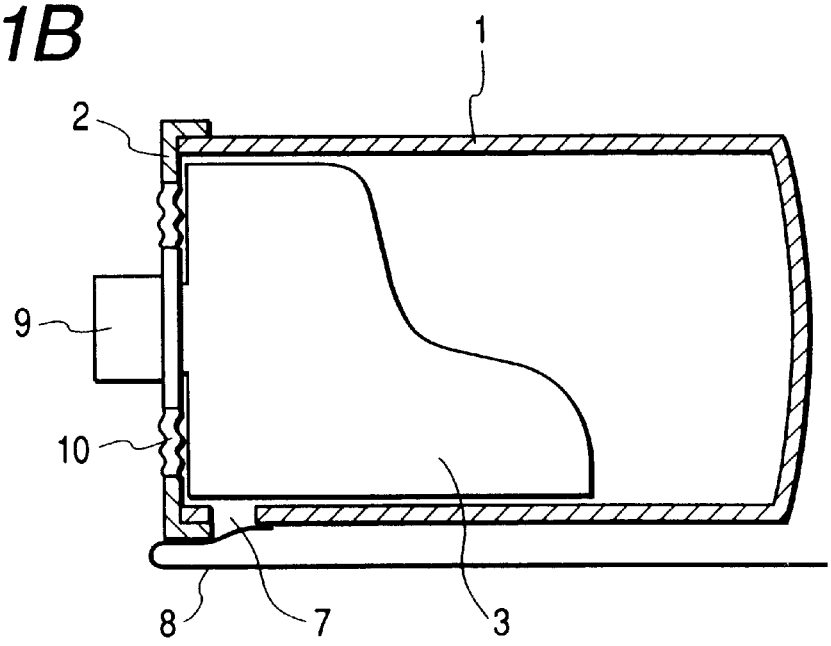

The toner container 0 of the present embodiment is principally composed, as shown in FIGS. 1A and 1B, of a container main body 1, a flange portion 2 and a baffle plate 3, which will be explained in the following.

Figure 2:
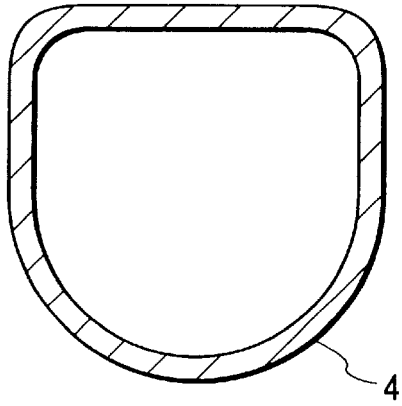
FIG. 2 is a schematic cross-sectional view of a tubular portion of the toner container of a different shape.

The container main body 1 is composed of a hollow tube closed at an end, and the cross-sectional shape of the tube can be circular or D-shaped (square and circle) as shown in FIG. 2, but at least a portion 4 at the bottom is approximately arc-shaped in order that the toner in the container can be effectively carried and discharged by the rocking motion of the container.

The container main body 1 can be composed of a resinous material such as polypropylene (PP), polyethylene (PE) or polystyrene (PS), or a metal such as stainless steel (SUS) or aluminum (Al), but is preferably formed by blow molding or injection molding of a resinous material in consideration of the quality, cost and mass producibility.

Figure 3B:
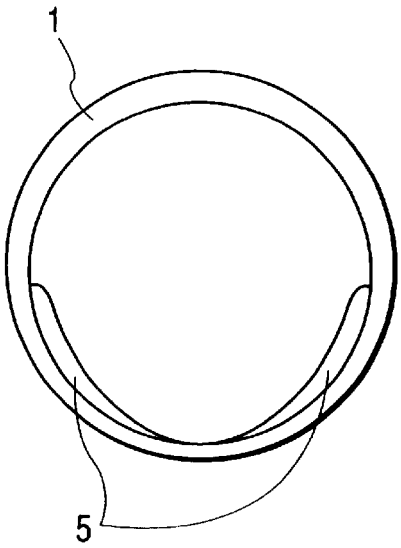
FIGS. 3A and 3B are respectively a longitudinal cross-sectional view and an elevation view schematically showing protruding stripes of a tubular portion in another embodiment.
Figure 3A:
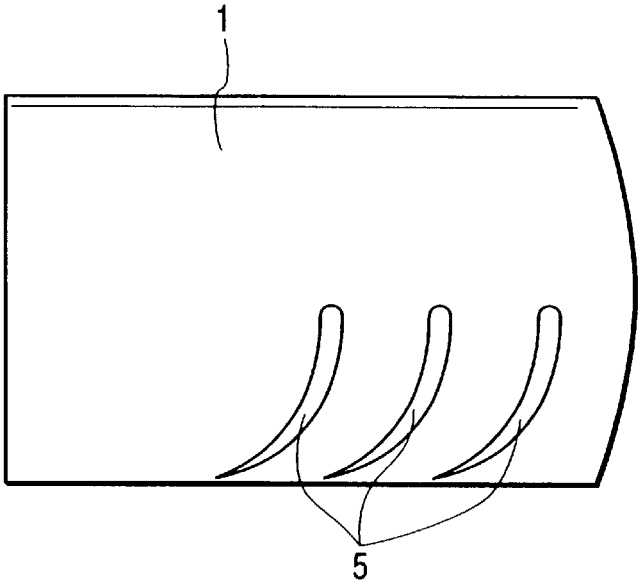

Inside the container main body 1, there are preferably provided protruding ribs 5, inclined in the carrying direction of the toner (cf. FIGS. 3A and 3B), in order to improve the carrying property of the toner in response to the reciprocating rocking motion of the container. The ribs 5 are for example a part of a spiral, inclined with respect to the axial direction of the container main body 1.

Figure 4B:
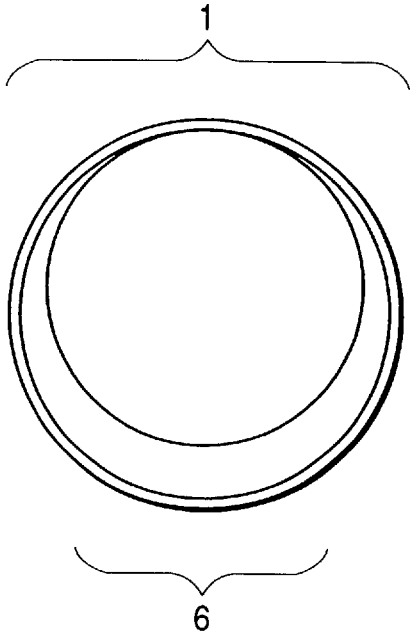
FIGS. 4A and 4B are respectively a longitudinal cross-sectional view and an elevation view schematically showing the shape of the tubular portion in another embodiment.
Figure 4A:
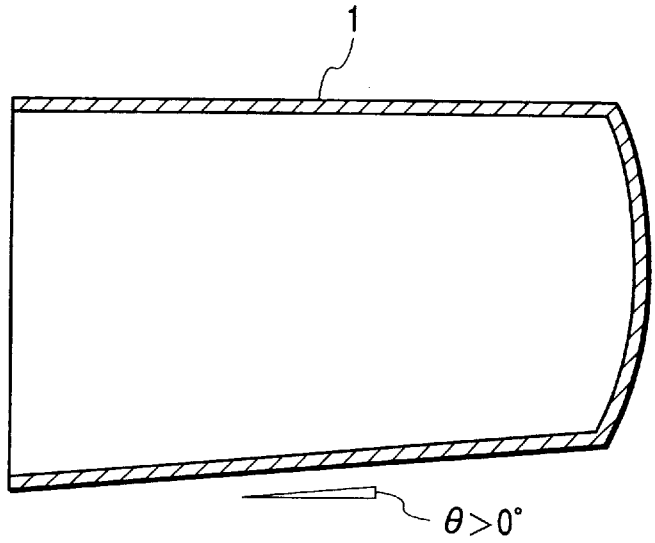

Also for decreasing the amount of remaining toner, it is effective to provide the container main body 1 with a configuration that a tube bottom 6 is somewhat inclined toward the discharging direction of the toner (cf. FIGS. 4A and 4B).

A toner discharge aperture may be provided in a part of the container main body 1 or in a part of the flange portion to be explained later, but the former case will be explained in the following.

The toner discharge aperture 7 is provided on the periphery of the tubular part of the container main body as shown in FIG. 1B, preferably at the lowest position or the vicinity thereof of the container main body 1 in the rocking motion thereof. It may be provided either in an intermediate position or a terminal position of the tubular part as long as it corresponds to the toner replenishing unit, but a position close to an end face of the container main body is preferred in consideration of the designing of the toner replenishing unit and the manufacture of the container main body.

Figure 5B:
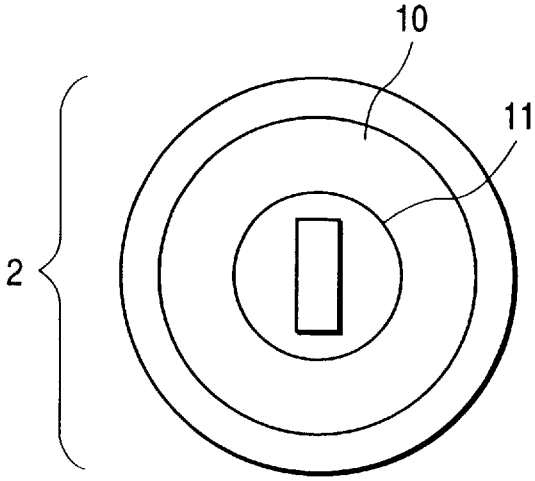
FIGS. 5A and 5B are respectively a longitudinal cross-sectional view and an elevation view schematically showing a flange portion.
Figure 5A:
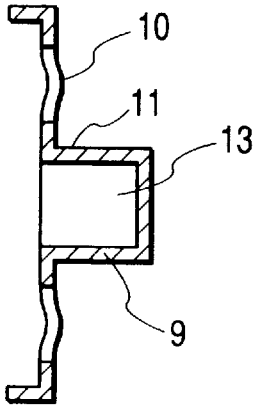

The flange portion 2 has a shape matching the engaging portion of the container main body 1, and is provided with an extendable portion 10 which at least partly extends as shown in FIGS. 5A and 5B against the reciprocating rocking motion of the container main body 1 and with a non-extendable portion 11. The extendable portion 10 is curve-shaped, as shown in FIGS. 5A and 5B, in a cross section containing the center line of the container main body 1.

Also in a part of the flange portion 2, there are provided a baffle plate 3 provided inside the container and a baffle fixing portion 9 for maintaining the baffle plate 3 in a fixed state against the reciprocating rocking motion of the container main body 1.

Figure 6B:
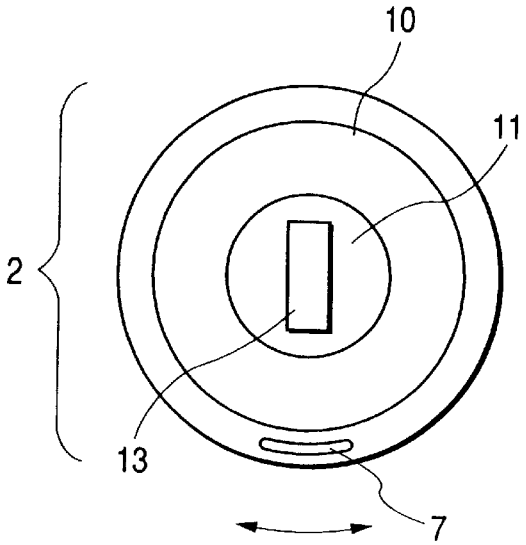
FIGS. 6A and 6B are respectively a longitudinal cross-sectional view and an elevation view schematically showing the position of a discharge aperture in another embodiment.
Figure 6A:
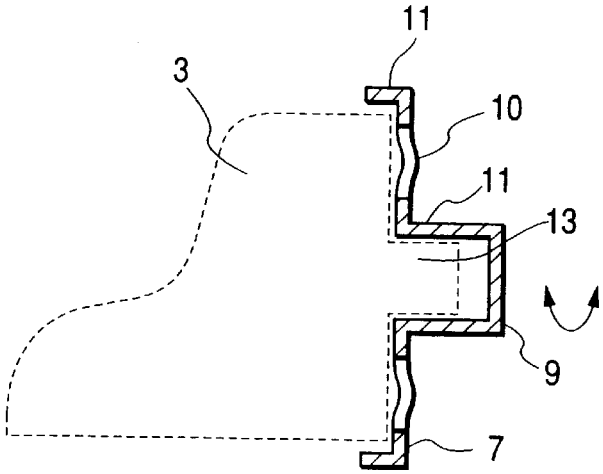

In case the toner discharge aperture 7 is provided in the flange portion 2, it is preferably positioned close to the periphery of the container main body 1 as shown in FIGS. 6A and 6B, so as that it executes the reciprocating rocking motion similar to that of the container main body 1, against the baffle plate 3.

The toner discharge aperture 7 can be sealed with an easy opening film or a slide shutter, having a packing member on a shutter.

In the flange portion 2, the non-extendable portion 11 can be composed of synthetic resin such as polypropylene (PP), polyethylene (PE) or polystyrene (PS), or a metal such as stainless steel (SUS) or aluminum (Al), while the extendable portion 10 can be composed of an elastic member such as of silicone rubber, styrene (rubber), butadiene rubber, EPDM, latex rubber or various elastomers, and the extendable portion and the non-extendable portion are preferably formed by injection molding or integrally formed by two-color molding or insertion molding in consideration of the quality and the cost, but they may also be mutually adhered for example by thermal fusion, ultrasonic fusion, or by an adhesive material.

Figure 7B:
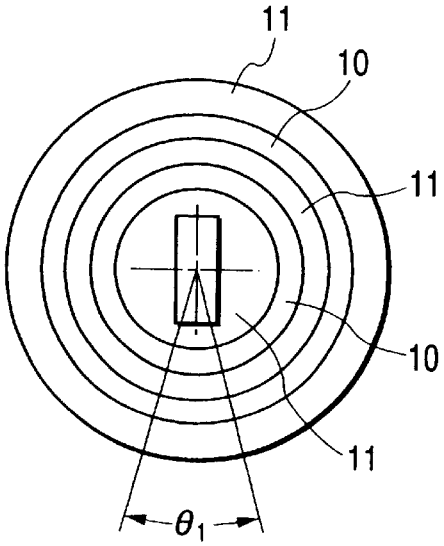
FIGS. 7A and 7B are respectively a longitudinal cross-sectional view and an elevation view schematically showing a flange portion in another embodiment.
Figure 7A:
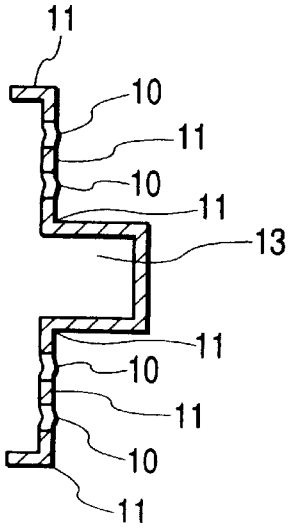

Within the flange portion 2, the extendable portion 10 and the non-extendable portion 11 are preferably formed in substantially concentric doughnut shape on a sheet material as shown in FIGS. 6A and 6B, and they may be provided in two or more sets according to the magnitude of the reciprocating rocking angle 01 as shown in FIGS. 7A and 7B in order to reduce the wrinkles in the extendable portion, generated in the reciprocating rocking motion of the container main body 1.

Figure 8B:
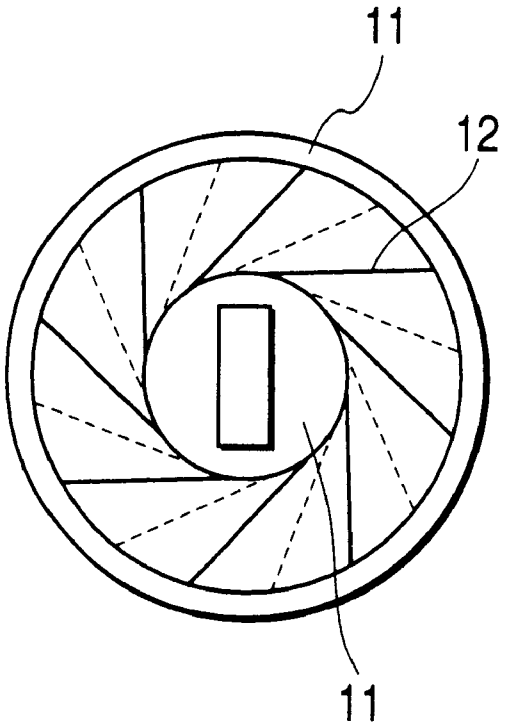
FIGS. 8A, 8B and 8C are respectively an elevation view, an elevation view in another configuration, and a cross-sectional view along a line 8C—8C in FIG. 8A, schematically showing the flange portion in another embodiment.
Figure 8C:
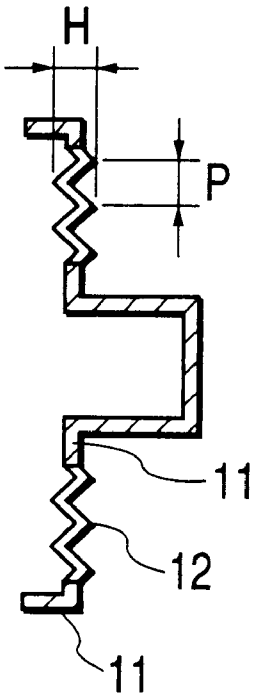
Figure 8A:
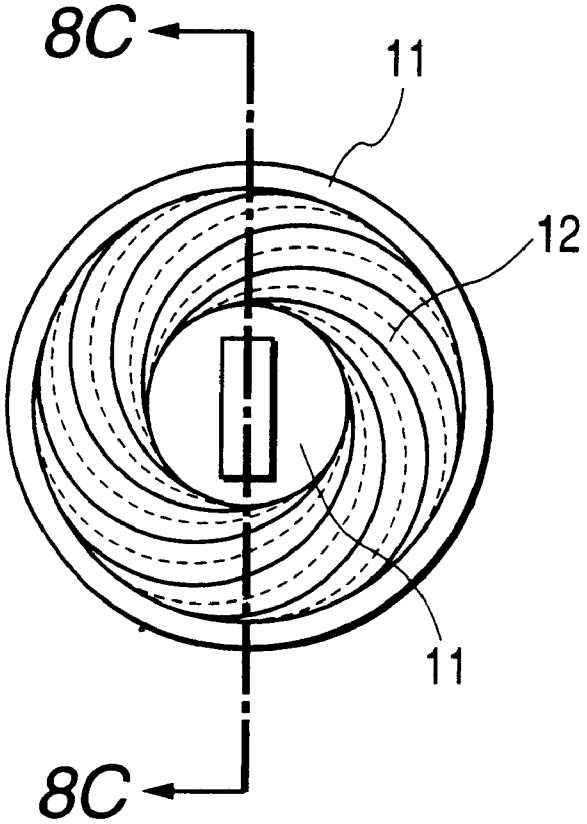

Also there may be employed an extendable portion 12 consisting of bellows structure formed on a sheet in a spiral pattern as shown in FIG. 8A or a radial pattern as shown in FIG. 8B, and the height H and the pitch P of such bellows structure may be arbitrarily selected according to the reciprocating rocking angle. There may further be employed a structure in which the above-mentioned pattern is combined with an inversely positioned pattern. The extendable portion of such bellows structure may be composed of a material similar to that constituting the aforementioned extendable portion.

The baffle plate 3 is fixed by fitting in a baffle mounting portion 13, which is a narrow hole formed in a baffle fixing portion 9 in the non-extendable portion 11 at the center of the flange portion 2, and extends toward the interior of the container main body 1. It maintains a non-moving state against the rocking motion of the container main body 1, thereby disintegrating the toner cohered and solidified in the container by the vibration in distribution or the like thereby improving the flowability of the toner, and effectively discharging the toner from the toner discharge aperture to the exterior of the container.

Figure 9B:
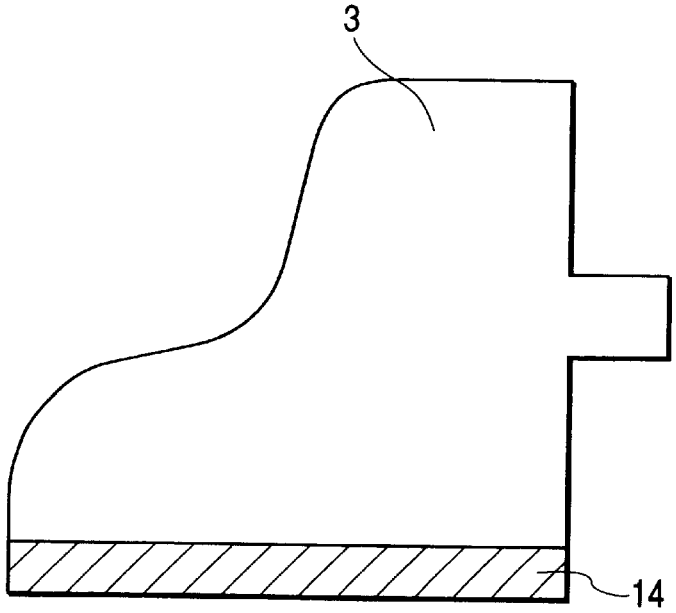
FIGS. 9A and 9B are respectively an elevation view and a lateral view schematically showing a baffle plate in another embodiment.
Figure 9A:
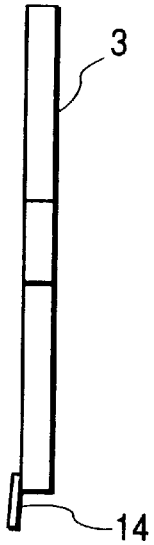

The aforementioned baffle plate 3 and the internal surface of the tubular portion of the container main body 1 are maintained in a mutually non-contacting state in order to avoid generation of the coarse toner particles in the course of rocking motion, but there is more preferred a configuration shown in FIGS. 9A and 9B in which a flexible sheet 14 composed for example of urethane rubber or polyester film is mounted on an edge of the baffle plate so as to be in contact with the internal surface of the tubular portion of the container main body, thereby reducing the remaining toner amount. In such case the coarse toner particles are not generated because of the use of the flexible sheet 14.

Figure 10:
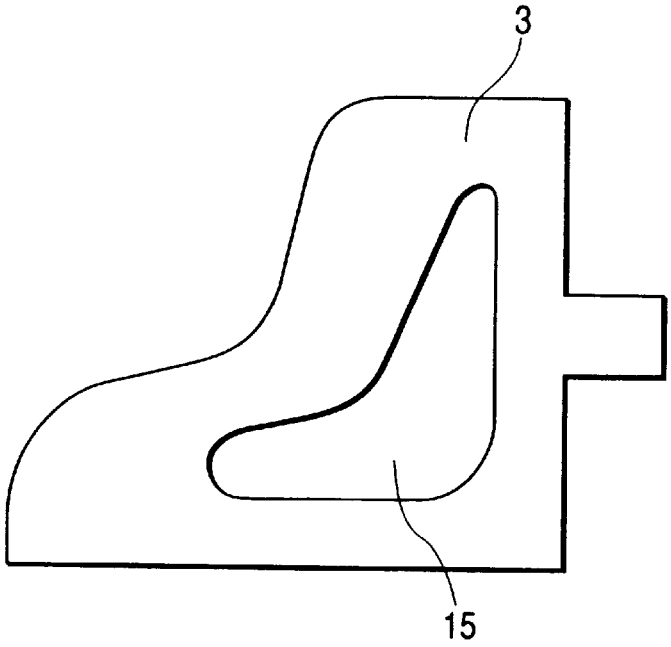
FIG. 10 is a schematic lateral view showing the baffle plate in another embodiment.

Also the baffle plate 3 is effectively provided with a window 15 as shown in FIG. 10, in order to reduce the torque required for disintegrating the toner at the rocking motion of the container main body 1, and such window provides an effect of balancing the amounts of toner on both sides of the baffle plate 3, since the toner can move through the window 15 within the container.

[Assembling Method of Toner Container]

Figure 11:
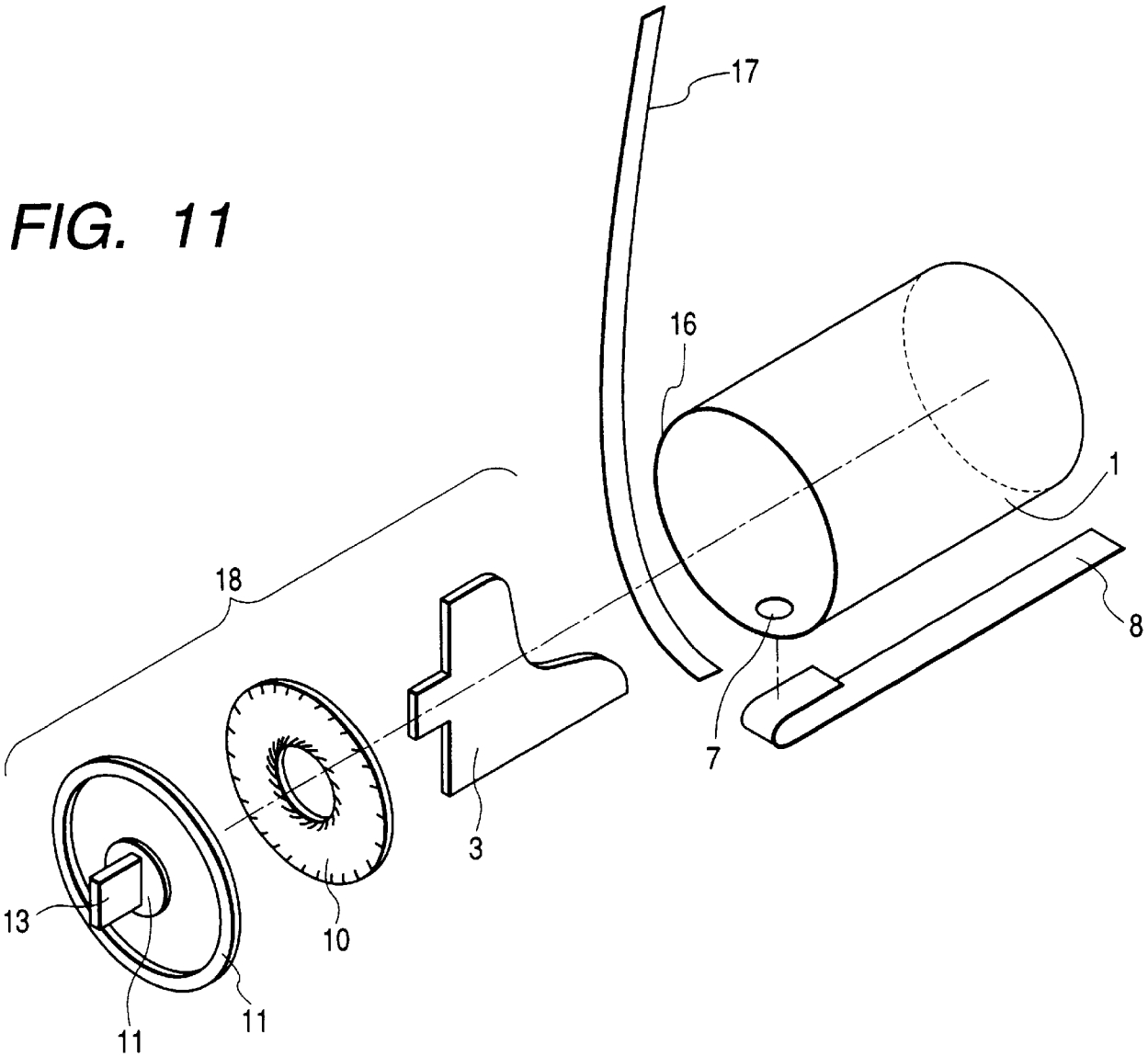
FIG. 11 is a schematic perspective view as to the assembling of the toner container.

The assembling method of the toner container will be explained with reference to FIG. 11.

The tubular container main body 1, the non-extendable flange portion 11, the extendable flange portion 10 and the baffle plate 3 are individually prepared for example by injection molding.

Then the non-extendable portion 11 and the extendable portion 10 are adhered.

The adhesion may be conducted in any method, such as thermal fusion, ultrasonic fusion or adhesion with a double-sided tape, as long as sufficient sealing is secured. In this embodiment there was employed adhesion with a double-sided tape. Then the non-extendable portion 11 and the baffle plate 3 are adhered.

The fixation is achieved f or example by lightly pressing the baffle plate into the baffle mounting portion 13 of the non-extendable portion 11. Otherwise the non-extendable portion 11 and the baffle plate 3 may be integrally formed in advance. In this manner the flange unit 18 can be integrated.

On the other hand, the toner discharge aperture 7 formed in the container main body 1 is sealed by thermal fusion of an easy-open film 8. Otherwise there may be adhered a film having an adhesive layer.

Figure 12A:
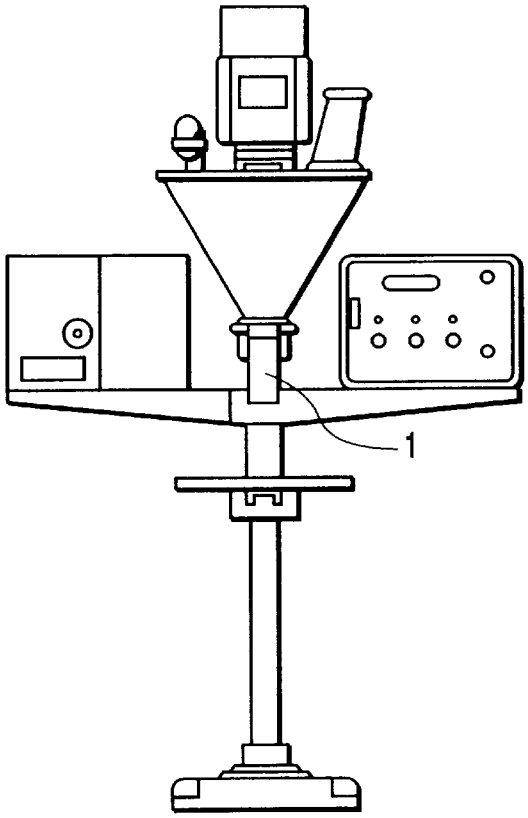
FIGS. 12A and 12B are respectively an elevation view and a lateral view schematically showing an Auger-type toner feeding machine (filler)
Figure 12B:
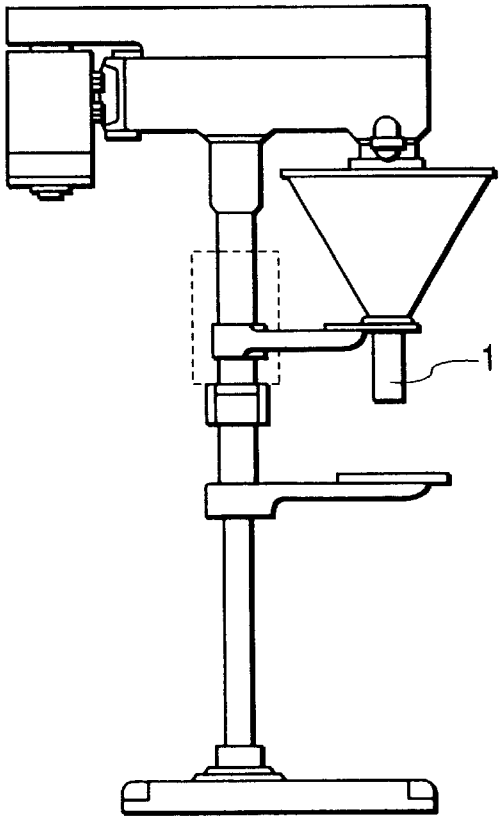

Then an Auger-type toner feeding machine (filler) shown in FIGS. 12A and 12B is employed to fill the toner of a predetermined amount into the container main body 1 with the sealed toner discharge aperture 7. On the open end 16 of the container main body 1 filled with the toner, the flange unit 18 on which the baffle plate 3 is mounted in advance is placed and is adhered to the container main body 1 in such a manner that the toner does not leak. The adhesion can be achieved by applying an adhesive tape 17 for example of polypropylene. There may also be employed other methods such as ultrasonic fusion or hot melting, but the adhesive tape application is preferred in consideration of the recycling property.

Instead of the above-described assembling method, there may be adopted a method of forming a toner filling aperture, different from the aperture of the container main body 1, for example on the bottom face thereof. In such case, after the container main body 1 and the flange unit 18 are adhered as explained in the foregoing, the toner of the predetermined amount may be filled from such toner filling aperture, which may thereafter be closed with a sealing member such as a cap.

In the following there will be explained the toner replenishing operation with the toner container 0 of the aforementioned configuration shown in FIG. 1A.

Figure 13A:
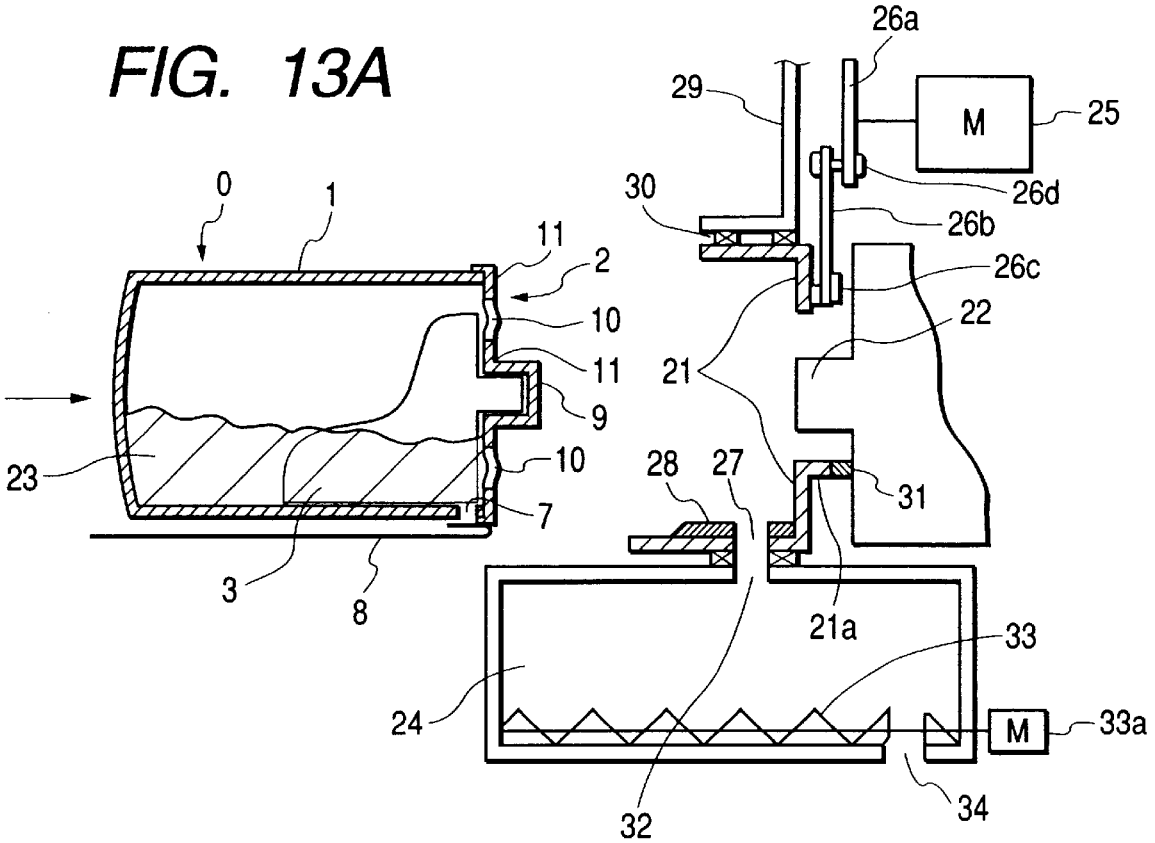
FIGS. 13A and 13B are schematic longitudinal cross-sectional views of a toner replenishing device respectively before and after the mounting of the toner container.
Figure 13B:
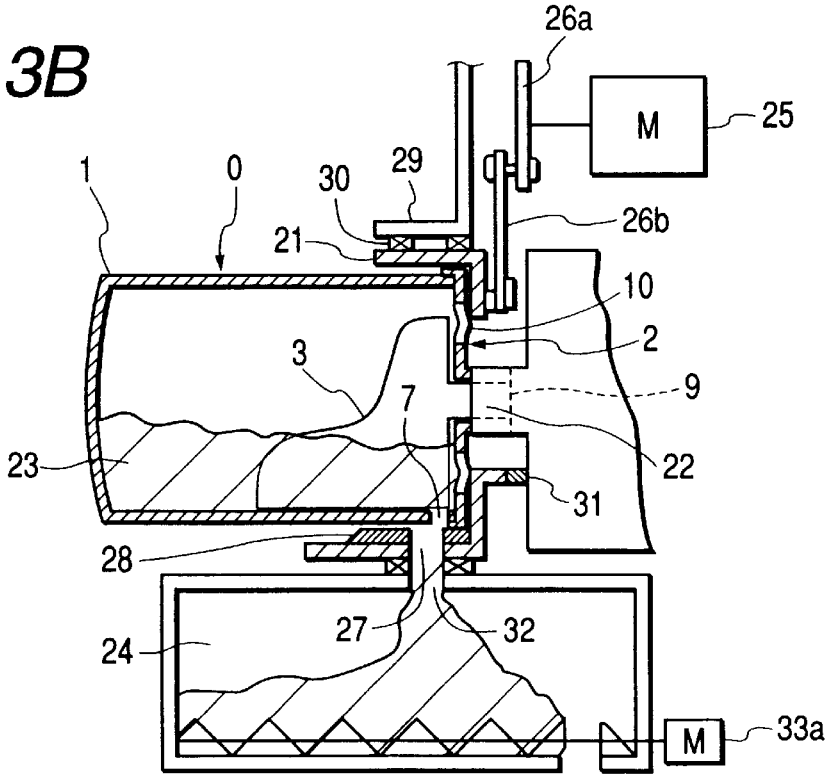

FIGS. 13A and 13B are schematic views of a toner replenishing unit.

The toner replenishing unit is composed of a drive unit 21 having a cylindrical external periphery in which the toner container 0 is fitted for the reciprocating rocking motion, a baffle locking unit 22 for engaging with the baffle fixing portion 9 of the flange portion 2 of the toner container 0 and maintaining the baffle plate in a fixed state against the reciprocating rocking motion of the container main body 1, and a developing buffer 24 for discharging the toner 23 contained in the toner container 0 through the discharge aperture 7 for supply to the developing unit.

Referring to FIGS. 13A and 13B, a link rod 26*b*, positioned substantially perpendicular to the plane of the drawing, is connected with the drive unit 21 by a pin 26*c* and executes a rocking motion between the tangential lines of a circle passing through the pin 26*c*, around the rotary center of the drive unit 21.

In the drive unit 21, a motor 25 rotates to cause a reciprocating rocking motion of the link rod 26*b*, which is linked at an end thereof by a pin 26*d* to a crank disk 26*a* fixed to the shaft of the motor 25, whereby the drive unit 21 executes a reciprocating rocking motion with an angle and a reciprocating speed defined by the rotation speed of the motor 25 and the length of the link rod 26*b*. The drive unit 21 is also provided with a toner receiving aperture 27 in a position engaging with the discharge aperture 7 of the toner container 0, and such aperture is surrounded by an elastic member to seal the toner. Also on the external surface of the drive unit 21, there are provided a sliding packing 30 for sliding on and sealing the cylindrical portion of a drive guide unit 29 and the external surface of the developing buffer 24, and a sliding packing 31 on a projection 21*a* provided for sliding with a baffle locking portion 22. The sliding packings 30 are provided on both sides of the toner receiving aperture 27 so as to surround the external periphery thereof, thereby insulating the drive guide portion 29 from the drive unit 21. In case the container main body 1 is cylindrical, the packing 30 can be composed of an oil seal or a V-shaped seal of a rubber material, and, in case the container main body 1 is rectangular, it can be composed of a rubber strip. The sliding packing 31 is composed of an elastic member such as foamed polyurethane.

The developing buffer 24 is provided with a toner supply aperture 32 coinciding with the toner receiving aperture 27 and constituting a toner passing aperture of the drive unit 21 between the parallel sliding packings 30, and a carrying screw 33 driven by a motor 33*a* for carrying the toner toward a toner discharge aperture 34, which communicates with the developing unit (not shown). The discharge aperture 7, the toner receiving aperture 27 and the toner supply aperture 32 described above are so positioned that they always communicate even during the rocking motion of the container main body 1.

Referring to FIG. 13A, the toner container 0 is pushed in a direction indicated by an arrow, and is set in the drive unit 21 of the toner replenishing unit.

Then the easy-open film 8 is peeled off to open the discharge aperture 7, whereby it communicates with the toner supply aperture 32 through the toner receiving aperture 27, as shown in FIG. 13B.

In the state shown in FIG. 13B, the baffle fixing portion 9 of the toner container 0 engages with the baffle locking unit 22, and a part of the external periphery of the container main body 1 engages with the drive unit 21 whereby the toner container 0 is rendered capable of reciprocating rocking motion by the rocking force of the drive unit 21.

Figure 14A:
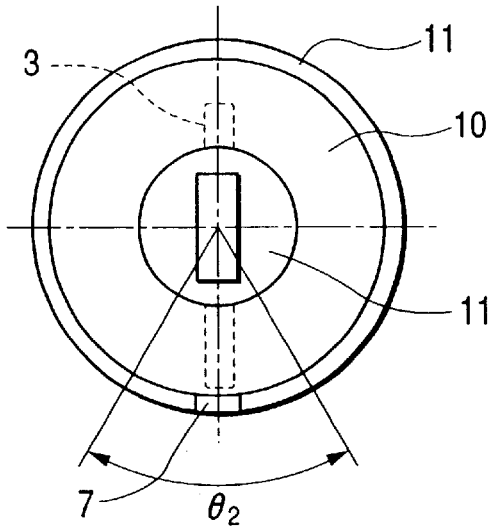
FIGS. 14A, 14B and 14C are elevation views showing the function of the flange portion.
Figure 14B:
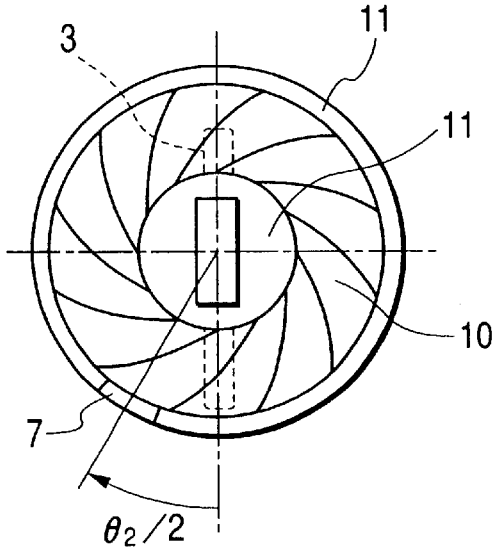
Figure 14C:
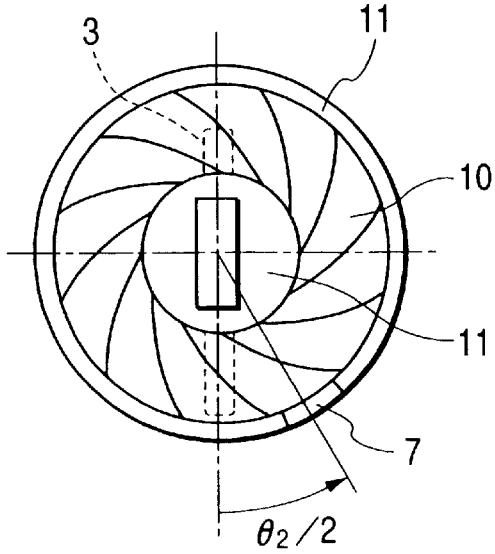

FIGS. 14A to 14C show the state of the flange portion 2 while the toner container 0 executes the reciprocating rocking motion.

FIG. 14A shows a state at the setting on the toner replenishing unit, wherein the toner discharge aperture 7 is in a vertically low position and the extendable portion 10 is not subjected to the stress of the rocking motion.

FIG. 14B shows a state in which the toner container 0 is moved by a rocking angle $\theta_2/2$ by the function of the drive unit 21. The toner discharge aperture 7 and the container main body 1 are displaced by $\theta_2/2$ from the rocking axis, while the baffle plate 3 remains fixed regardless of the above-mentioned movement. By the rotation of the container main body 1 by $\theta_2/2$, the extendable portion 10 is extended in a twisting direction.

Then the container main body 1 rocks in the opposite direction to assume again the state shown in FIG. 14A and then to a state shown in FIG. 14C by a further movement by $\theta_2/2$. The extendable portion 10 assumes an extended state, twisted in the opposite direction.

By the reciprocating rocking motion, repeating the states in the order of FIGS. 14A, 14B, 14A, 14C and 14A, the toner 23 in the toner container 0 is swept by the baffle plate 3 and is discharged from the toner discharge aperture 7 to the developing buffer 24.

In the following there will be explained the result of a discharge test of the present embodiment.

A toner container 0 having an internal diameter of 80 mm and an internal volume 500 cc (500 $cm^3$) was filled with 300 g of one-component magnetic toner, and, after vertical tapping 1000 times from a height of 2 cm, it was set on the above-described toner replenishing unit and subjected to the reciprocating cycles within a range of 10 to 60 times/minute and within an angular range of 30° ($\pi/6$ rad) to 180° ($\pi$ rad). In any of these conditions, the toner discharge was satisfactory, and was started from immediately after the start of the reciprocating rocking motion, with the remaining toner amount as low as 3 to 5 g.

In the following there will be explained another embodiment of the toner container and the toner replenishing unit.

Figure 17A:
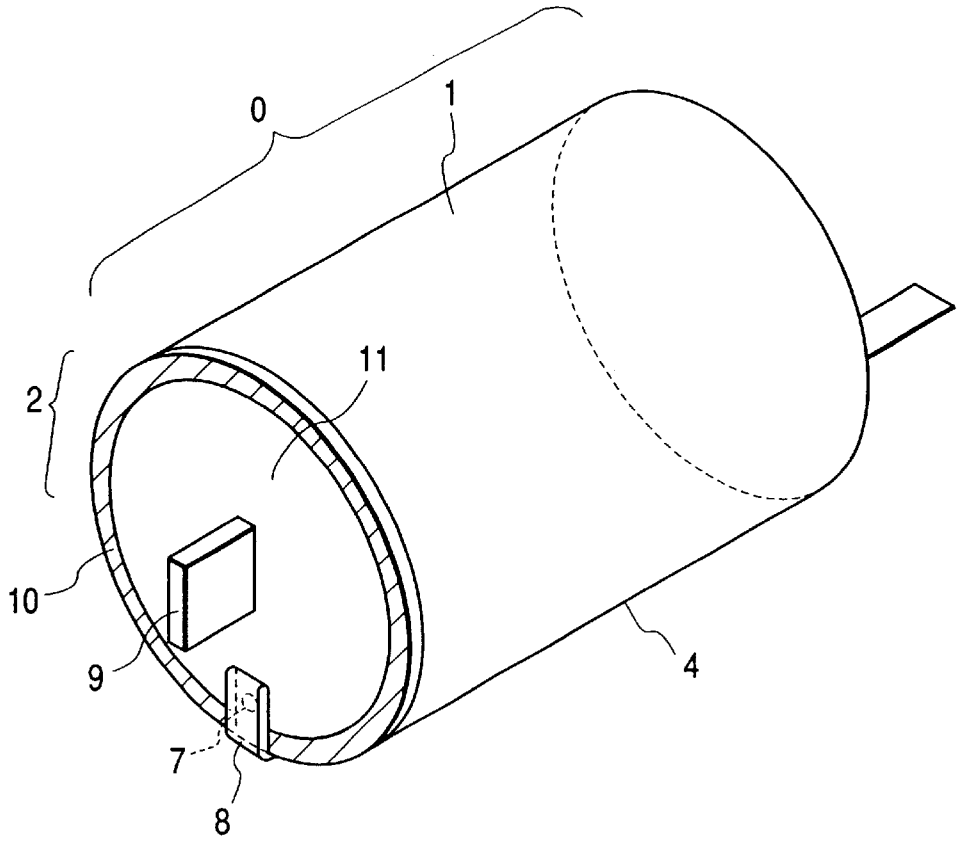
FIGS. 17A and 17B are respectively a perspective view and a longitudinal cross-sectional view of another embodiment of the toner container.
Figure 17B:
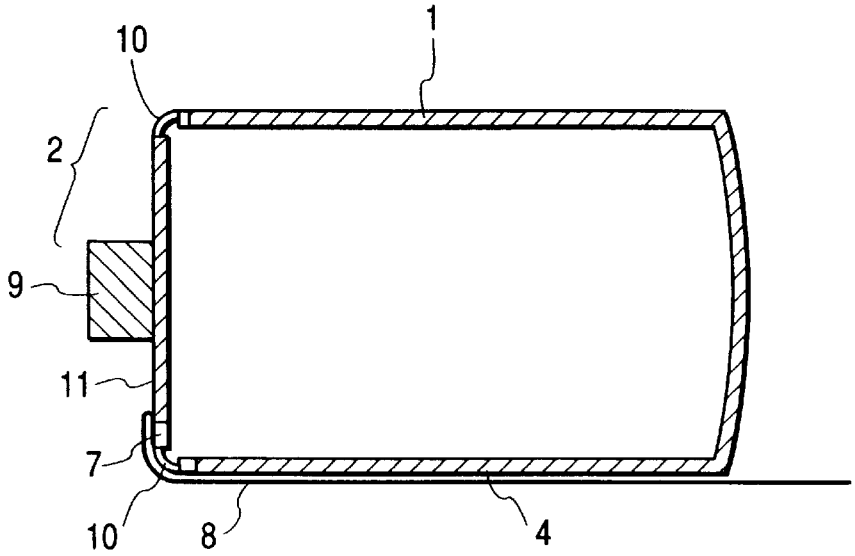

The toner container 0 of the present embodiment is principally composed, as shown in FIGS. 17A and 17B, of a container main body 1 and a flange portion 2, which will be explained in the following.

The container main body 1 is composed of a hollow tube closed at an end, and the cross-sectional shape of the tube can be circular or D-shaped as shown in FIG. 2, but at least a portion 4 at the bottom is approximately arc-shaped in order that the toner in the container can be effectively carried and discharged by the rocking motion of the container.

The container main body 1 can be composed of a resinous material such as polypropylene (PP), polyethylene (PE) or polystyrene (PS), or a metal such as stainless steel (SUS) or aluminum (Al), but is preferably formed by blow molding or injection molding of a resinous material in consideration of the quality, cost and mass producibility.

Inside the container main body 1, there are preferably provided protruding ribs 5, inclined in the carrying direction of the toner (cf. FIGS. 3A and 3B), in order to increase the carrying property of the toner in response to the reciprocating rocking motion of the container. The ribs 5 are for example a part of a spiral, inclined with respect to the axial direction of the container main body 1.

Also for decreasing the amount of remaining toner, it is effective to provide the container main body 1 with a configuration that a tube bottom 6 is somewhat inclined toward the discharging direction of the toner (cf. FIGS. 4A and 4B).

Figure 19B:
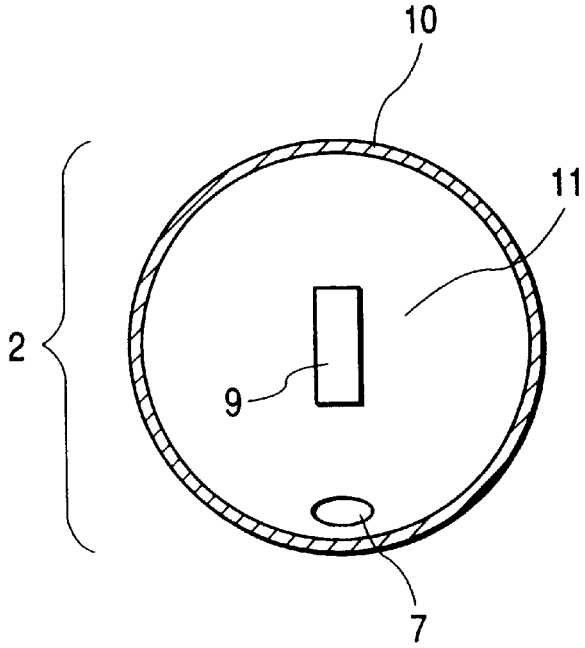
FIGS. 19A and 19B are respectively a longitudinal cross-sectional view and an elevation view schematically showing the flange portion in another embodiment.
Figure 19A:
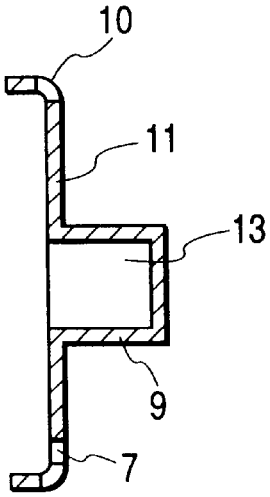

The flange portion 2 has a shape matching the engaging portion of the container main body 1, and is provided with an extendable portion 10 which at least partly extends as shown in FIGS. 19A and 19B against the reciprocating rocking motion of the container main body 1 and with a non-extendable portion 11. A toner discharge aperture 7 is provided in the non-extendable portion in the vicinity of the periphery of the flange portion 2 in such a manner that it can maintain a still state against the rocking motion of the container main body 1 by the driving force of the toner replenishing unit (not shown). The extendable portion 10 is curve-shaped, as shown in FIG. 19A, in a cross section containing the center line of the container main body 1.

Figure 18:
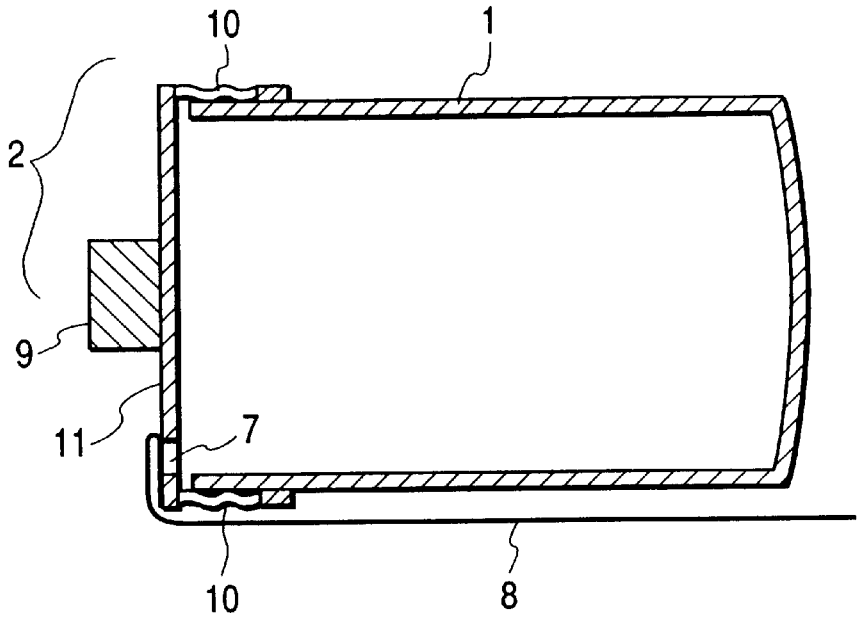
FIG. 18 is a schematic longitudinal cross-sectional view showing an extendable portion of another embodiment.

Also the extendable portion 10 of the flange portion 2 may be extended toward the tubular face of the container main body 1 as shown in FIG. 18.

In case the toner discharge aperture 7 is provided in the flange portion 2, it is preferably positioned close to the periphery of the container main body 1 as shown in FIGS. 19A and 19B. In the reciprocating rocking motion, the container main body 1 executes the reciprocating rocking motion against the non-extendable portion 11 and the baffle plate 3.

The toner discharge aperture 7 can be sealed with an easy opening film or a slide shutter, having a packing member on a shutter.

In the flange portion 2, the non-extendable portion 11 can be composed of synthetic resin such as polypropylene, polyethylene or polystyrene, or a metal such as stainless steel or aluminum, while the extendable portion 10 can be composed of an elastic member such as of silicone rubber, styrene, butadiene rubber, EPDM, latex rubber or various elastomers, and the extendable portion and the non-extendable portion are preferably formed by injection molding or integrally formed by two-color molding or insertion molding in consideration of the quality and the cost, but they may also be mutually adhered for example by thermal fusion, ultrasonic fusion, or by an adhesive material.

Within the flange portion 2, the extendable portion 10 and the non-extendable portion 11 are preferably formed in substantially concentric doughnut shape on a sheet material as shown in FIGS. 19A and 19B.

[Assembling Method of Toner Container]

Figure 20:
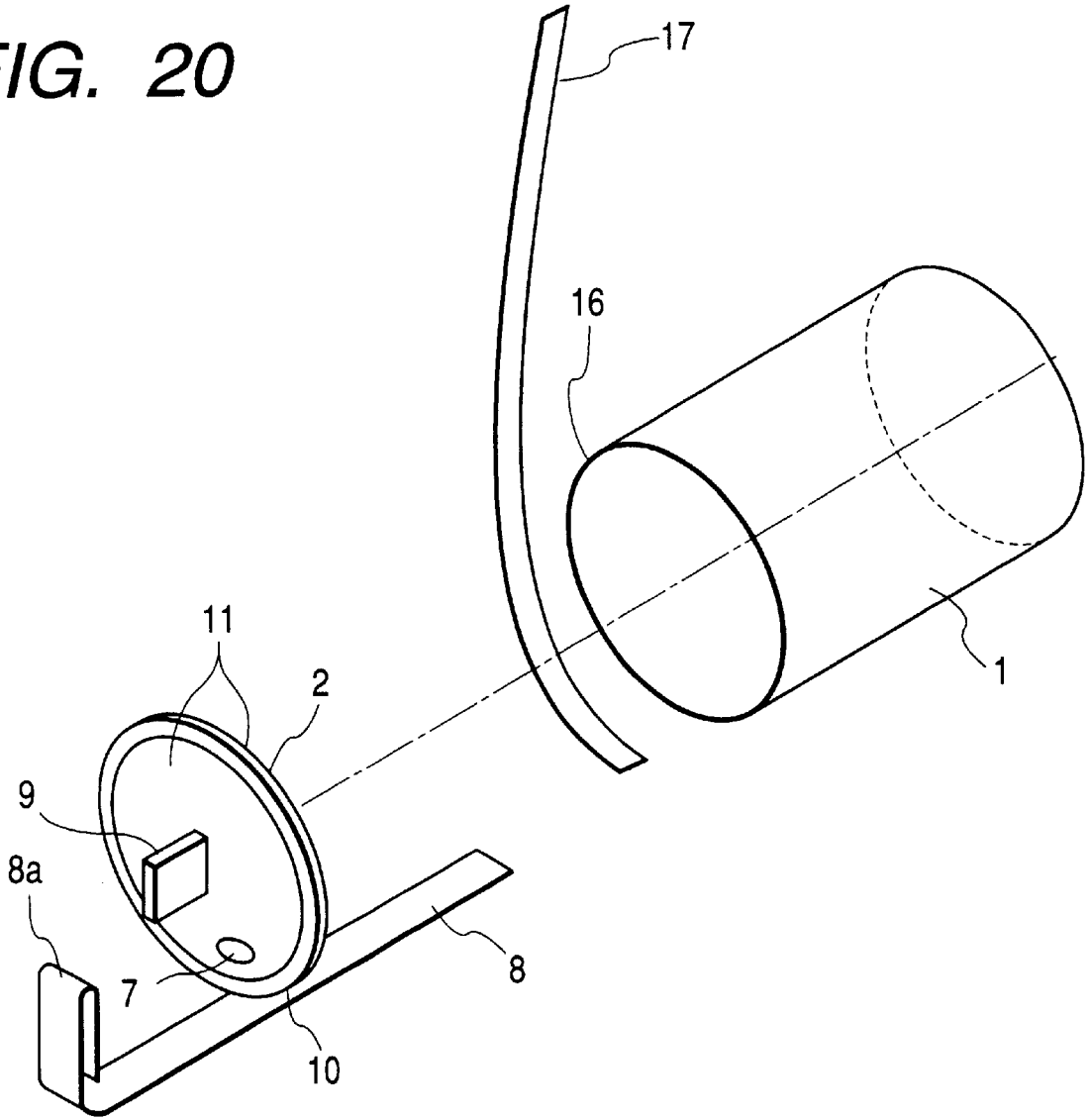
FIG. 20 is a schematic perspective view as to the assembling of the toner container of another embodiment.

The assembling method of the toner container will be explained with reference to FIG. 20.

The tubular container main body 1, the non-extendable flange portion 11 and the extendable flange portion 10 are individually prepared for example by injection molding.

In case the non-extendable portion 11 and the extendable portion 10 are formed separately, the adhesion may be conducted in any method, such as thermal fusion, ultrasonic fusion or adhesion with a double-sided tape, as long as sufficient sealing is secured. In this embodiment the extendable portion and the non-extendable portion were prepared by two-color molding.

The toner discharge aperture 7 formed in the flange non-extendable portion 11 is sealed by thermal fusion of an easy-open film 8. Otherwise there may be adhered a film having an adhesive layer.

The film 8 is adhered at an end, from the external periphery side of the flange portion 2 toward the central portion thereof, then folded by 180° (a rad) at a turn-back part 8*a*, further superposed on the already adhered film 8, and, after the flange portion 2 is adhered to the container main body 1, adhered to the external periphery of the flange portion 2 along the generatrix of the container main body and finally onto the container main body 1 in peelable manner.

Then an Auger-type toner feeding machine shown in FIGS. 12A and 12B is employed to fill the toner of a predetermined amount into the container main body 1. On the open end 16 of the container main body 1 filled with the toner, the flange portion 2 on which the easy-open film is thermally fused is placed and is adhered to the container main body 1 in such a manner that the toner does not leak. The adhesion can be achieved by applying an adhesive tape 17 for example of polypropylene or polyethylene. There may also be employed other methods such as ultrasonic fusion or hot melting, but the adhesive tape application is preferred in consideration of the recycling property.

Instead of the above-described assembling method, there may be adopted a method of forming a toner filling aperture, different from the aperture of the container main body 1, for example on the bottom face thereof. In such case, after the container main body 1 and the flange portion 2 are adhered as explained in the foregoing, the toner of the predetermined amount may be filled from such toner filling aperture, which may thereafter be closed with a sealing member such as a cap.

In the following there will be explained the toner replenishing operation with the toner container 0 of the aforementioned configuration (cf. FIGS. 17A and 17B).

Figure 21A:
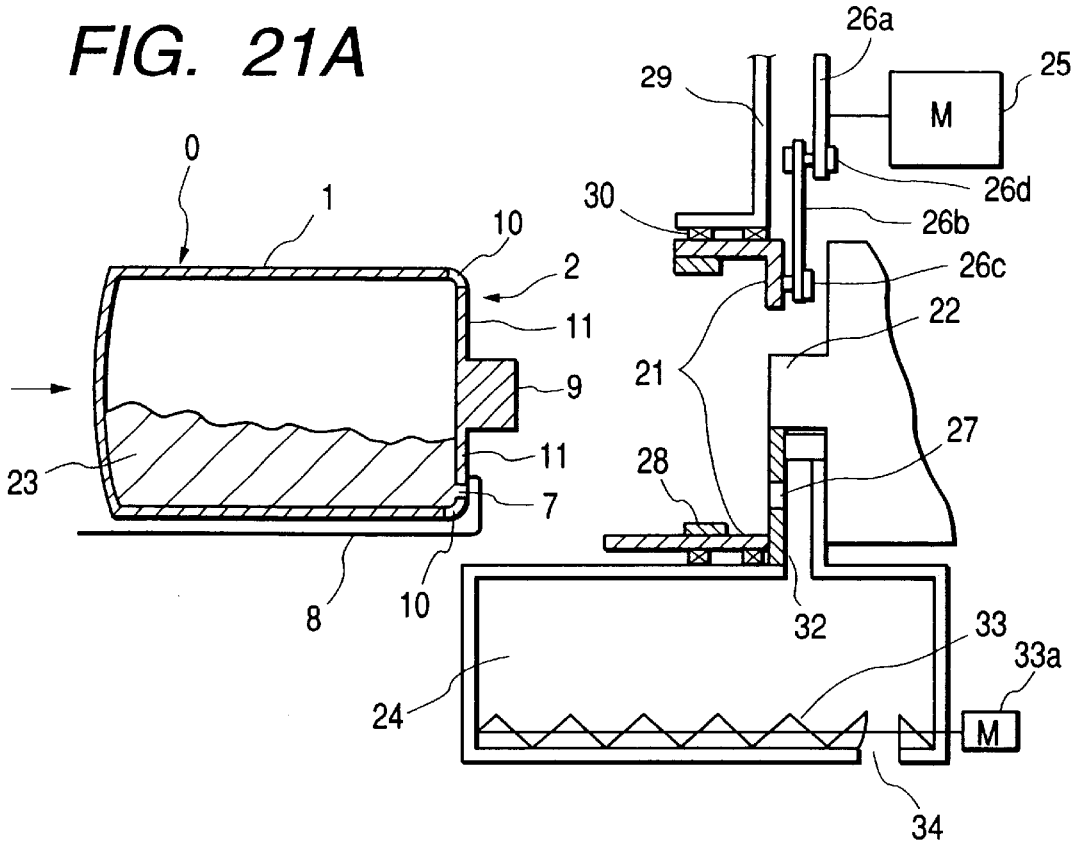
FIGS. 21A and 21B are schematic views of the toner replenishing device of another embodiment respectively before and after the mounting of the toner container.
Figure 21B:
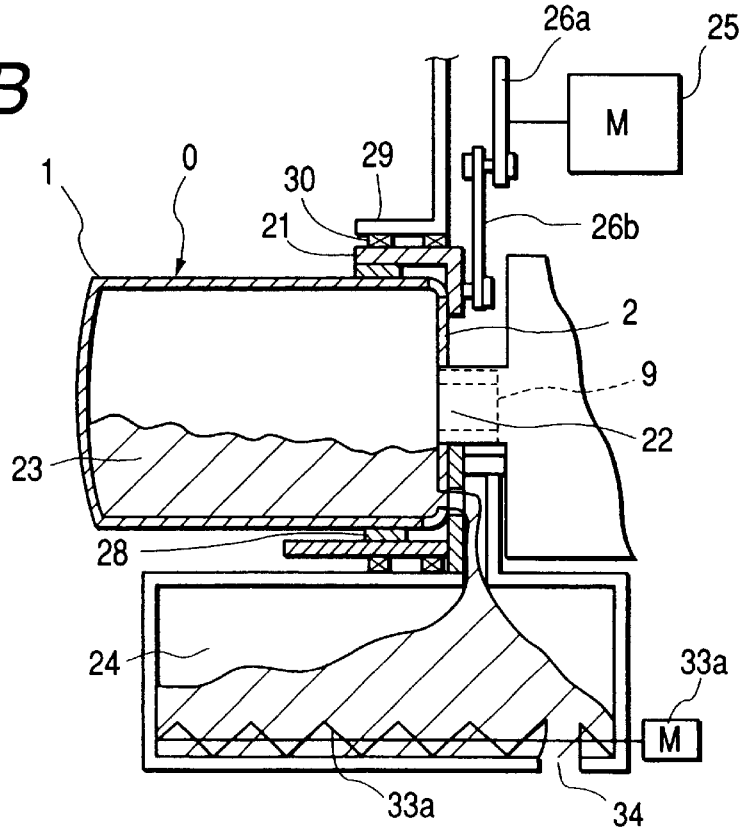

FIGS. 21A and 21B are schematic views of a toner replenishing unit.

In the toner replenishing unit, a drive unit 21 rocking the toner container 0 engages with a locking unit 22 engaging with the fixing portion 9 of the flange portion 2 of the toner container 0 to maintain a fixed state against the reciprocating rocking motion of the container main body 1, in order to engage a toner receiving aperture 27 engaging with the toner discharge aperture 7. Further the toner replenishing unit is provided with a developing buffer 24 for discharging the toner 23 contained in the toner container 0 through the discharge aperture 7 for supply to the developing unit.

Referring to FIGS. 21A and 21B, a link rod 26*b*, positioned substantially perpendicular to the plane of the drawing, is connected with the drive unit 21 by a pin 26*c* and executes a rocking motion between the tangential lines of a circle passing through the pin 26*c*, around the rotary center of the drive unit 21.

In the drive unit 21, a motor 25 rotates to cause a reciprocating rocking motion of the link rod 26*b*, which is linked at an end thereof by a pin 26*d* to a crank disk 26*a* fixed to the shaft of the motor 25, whereby the drive unit 21 executes a reciprocating rocking motion with an angle and a reciprocating speed defined by the rotation speed of the motor 25 and the length of the link rod 26*b*. The drive unit 21 is also provided with a toner receiving aperture 27 in a position engaging with the discharge aperture 7 of the toner container 0, and such aperture is surrounded by an elastic member 28 to seal the toner. Also on the external surface of the drive unit 21, there is provided a drive guide unit 29. A sliding member 30 is provided between the drive unit 21 and the drive guide unit 29/developing buffer 24.

The developing buffer 24 is provided with a toner supply aperture 32, and a carrying screw 33 driven by a motor 33*a* for carrying the toner toward a toner discharge aperture 34, which communicates with the developing unit (not shown).

Referring to FIG. 21A, the toner container 0 is pushed in a direction indicated by an arrow, and is set in the drive unit 21 of the toner replenishing unit.

Then the easy-open film 8 is peeled off to open the discharge aperture 7, whereby it communicates with the toner supply aperture 32 through the toner receiving aperture 27, as shown in FIG. 21B.

In the state shown in FIG. 21B, the fixing portion 9 of the toner container 0 engages with the locking unit 22, and a part of the external periphery of the container main body 1 engages with the drive unit 21 whereby the toner container 0 is rendered capable of reciprocating rocking motion by the rocking force of the drive unit 21.

Figure 22A:
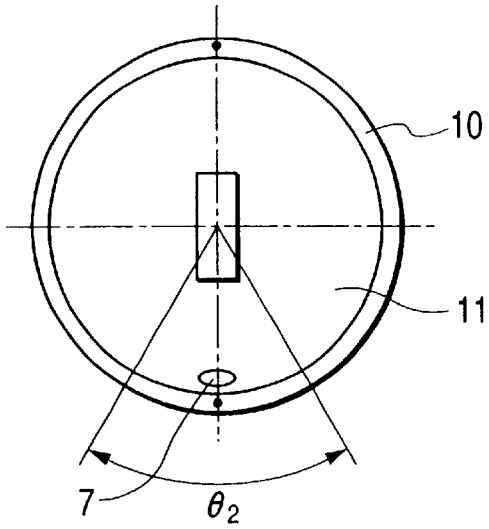
FIGS. 22A, 22B and 22C are elevation views showing the function of the flange portion in another embodiment.
Figure 22B:
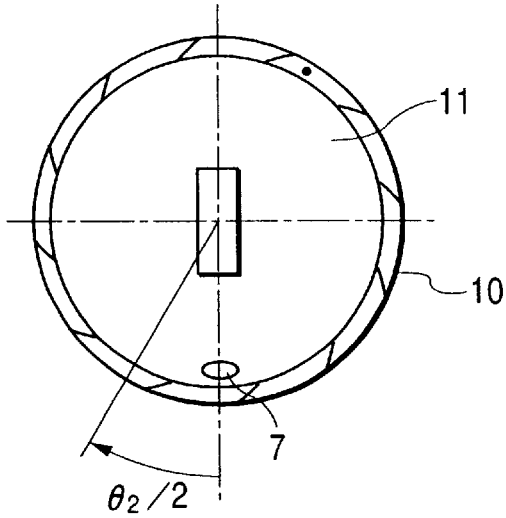
Figure 22C:
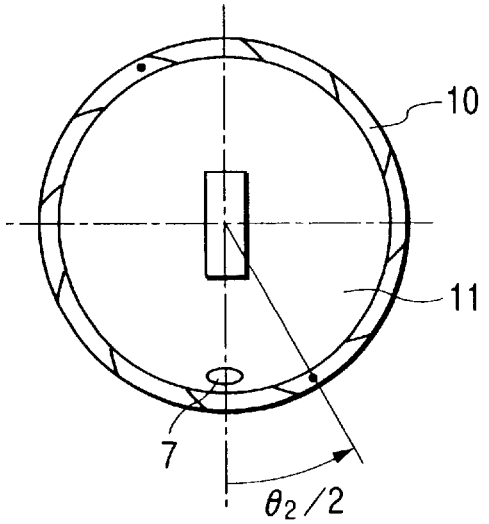

FIGS. 22A to 22C show the states of the flange portion 2 while the toner container 0 executes the reciprocating rocking motion.

FIG. 22A shows a state at the setting on the toner replenishing unit, wherein the toner discharge aperture 7 is in a vertically low position and the extendable portion 10 is not subjected to the stress of the rocking motion.

FIG. 22B shows a state in which the toner container 0 is moved by a rocking angle $\theta_2/2$ by the function of the drive unit 21. The toner discharge aperture 7 and the container main body 1 are displaced by $\theta_2/2$ from the rocking axis, while the toner discharge aperture 7 remains fixed regardless of the above-mentioned movement. By the rotation of the container main body 1 by $\theta_2/2$, the extendable portion 10 is extended in a twisting direction.

Then the container main body 1 rocks in the opposite direction to assume again the state shown in FIG. 22A and then to a state shown in FIG. 22C by a further movement by $\theta_2/2$. The extendable portion 10 assumes an extended state, twisted in the opposite direction. The discharge aperture 7 naturally maintains a same position.

By the reciprocating rocking motion, repeating the states in the order of FIGS. 22A, 22B, 22A, 22C and 22A, the toner 23 in the toner container 0 is carried toward the toner discharge aperture 7 and discharged to the developing buffer 24.

In the following there will be explained the result of a discharge test of the present embodiment.

A toner container 0 having an internal diameter of 80 mm and an internal volume 500 cc (500 $cm^3$) was filled with 300 g of one-component magnetic toner, and, after vertical tapping 1000 times from a height of 2 cm, it was set on the above-described toner replenishing unit and subjected to the reciprocating cycles within a range of 600 to 60 times/minute and within an angular range of 30° ($\pi/6$ rad) to 180° ($\pi$ rad). In any of these conditions, the toner discharge was satisfactory, and was started from immediately after the start of the reciprocating rocking motion, with the remaining toner amount as low as 5 to 15 g.

As explained in the foregoing, in the toner container of the present embodiment, at least a part of the flange portion provided at an end face of the container is formed extendable against the rocking motion of the container main body and there is employed a toner replenishing unit capable of causing rocking motion of such toner container, whereby the toner can be discharged without any difficulty even in case the toner is cohered and solidified by distribution, transportation or the like.

In the following there will be explained still another embodiment of the toner container and the toner replenishing unit.

Figure 23A:
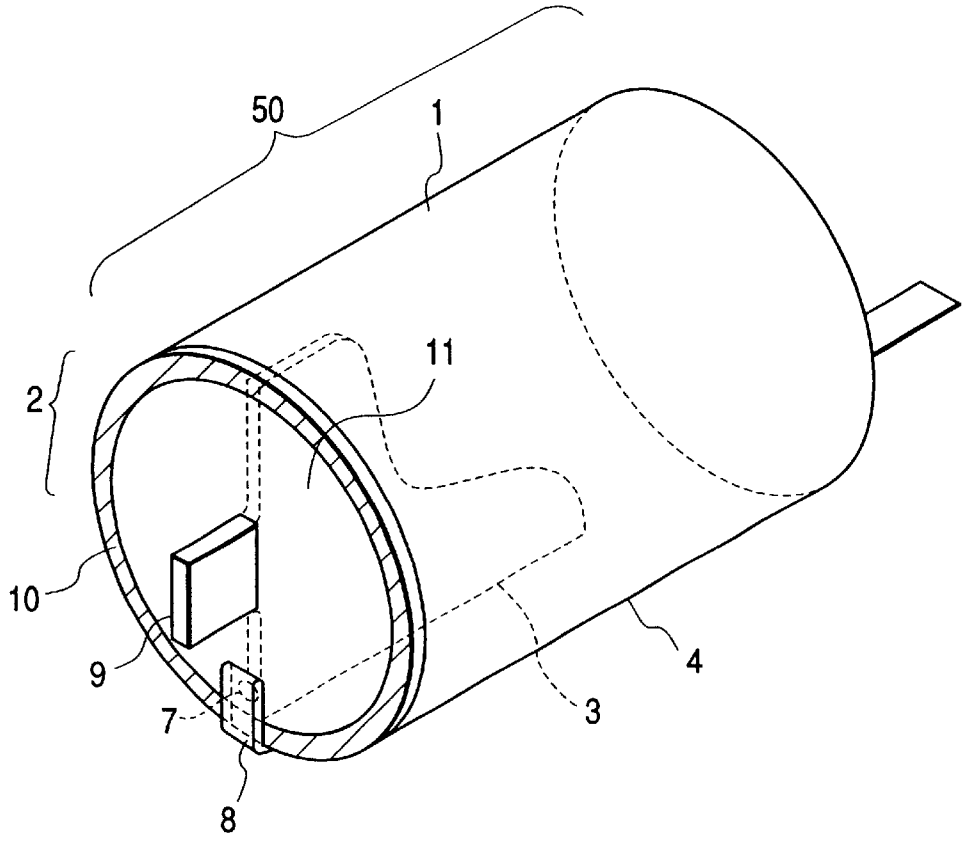
FIGS. 23A and 23B are respectively a perspective view and a longitudinal cross-sectional view of the toner container of another embodiment.
Figure 23B:
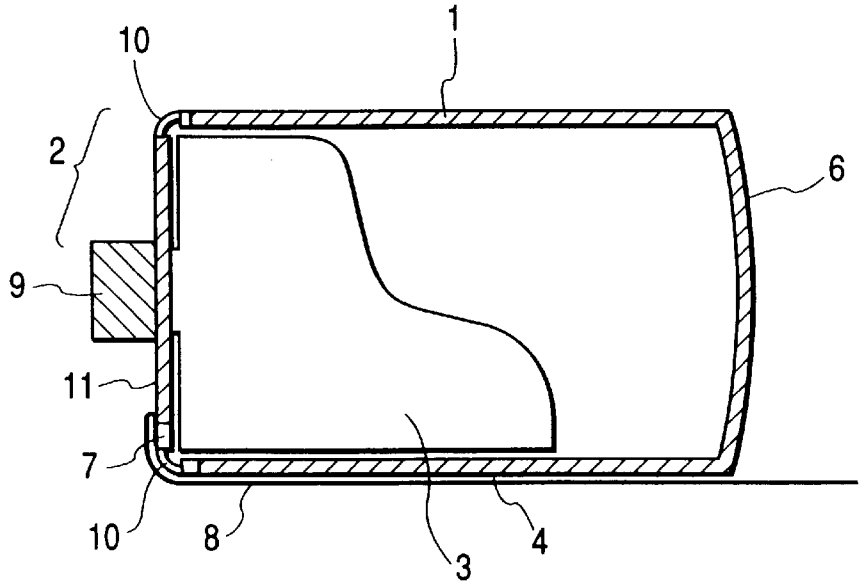

The toner container 0 of the present embodiment is principally composed, as shown in FIGS. 23A and 23B, of a container main body 1 and a flange portion 2, which will be explained in the following.

The container main body 1 is composed, as in the foregoing embodiments, of a hollow tube closed at an end, and the cross-sectional shape of the tube can be circular or D-shaped as shown in FIG. 2, but at least a portion 4 at the bottom is approximately arc-shaped in order that the toner in the container can be effectively carried and discharged by the rocking motion of the container.

The container main body 1 can be composed of a resinous material such as polypropylene, polyethylene or polystyrene, or a metal such as stainless steel or aluminum, but is preferably formed by blow molding or injection molding of a resinous material in consideration of the quality, cost and mass producibility.

Inside the container main body 1, there are preferably provided protruding ribs 5, inclined in the carrying direction of the toner (cf. FIGS. 3A and 3B), in order to increase the carrying property of the toner in response to the reciprocating rocking motion of the container. The ribs 5 are for example a part of a spiral, inclined with respect to the axial direction of the container main body 1.

Also for decreasing the amount of remaining toner, it is effective to provide the container main body 1 with a configuration that a tube bottom 6 is somewhat inclined toward the discharging direction of the toner (cf. FIGS. 4A and 4B).

The toner discharge aperture 7 is positioned in a part of the flange portion 2 as shown in FIG. 23B, and is preferably in the lowest position of the flange portion 2 or the vicinity thereof.

As in the foregoing embodiment, the flange portion 2 has a shape matching the engaging portion of the container main body 1, and is provided with an extendable portion 10 which at least partly extends as shown in FIGS. 23A and 23B against the rocking motion of the container main body 1 and with a non-extendable portion 11. A toner discharge aperture 7 is provided in the non-extendable portion in the vicinity of the periphery of the flange portion 2 in such a manner that it can maintain a still state against the rocking motion of the container main body 1 by the driving force of the toner replenishing unit (not shown). The extendable portion 10 is curve-shaped, as shown in FIG. 23B, in a cross section containing the center line of the container main body 1.

Also as in the foregoing embodiment, the extendable portion 10 of the flange portion 2 may be extended toward the tubular face of the container main body 1 as shown in FIG. 18.

As in the foregoing embodiment, within the flange portion 2, the extendable portion 10 and the non-extendable portion 11 are preferably formed in a substantially concentric doughnut shape on a sheet material as shown in FIGS. 19A and 19B.

In the flange portion 2, the non-extendable portion 11 can be composed of synthetic resin such as polypropylene, polyethylene or polystyrene, or a metal such as stainless steel or aluminum, while the extendable portion 10 can be composed of an elastic member such as of silicone rubber, styrene rubber, butadiene rubber, EPDM, latex rubber or various elastomers, and the extendable portion 10 and the non-extendable portion 11 are preferably formed by injection molding or integrally formed by two-color molding or insertion molding in consideration of the quality and the cost, but they may also be mutually adhered for example by thermal fusion, ultrasonic fusion, or by an adhesive material.

In a part of the flange portion 2, there are also provided a baffle plate 3 extended toward the interior of the container and a baffle fixing portion 9 for fixing the baffle plate 3 in a still state against the rocking motion of the container main body 1.

The baffle plate 3 is provided with a projection 3*a*. The baffle plate 3 is fixed by fitting the projection 3*a* in a recessed baffle mounting portion 13, provided in the baffle fixing portion 9 of the non-extendable portion 11 of the flange portion 2, and extends toward the interior of the container main body 1. It maintains a still state against the rocking motion of the container main body 1, thereby disintegrating the toner cohered and solidified in the container by the vibration in the distribution or the like thereby improving the flowability of the toner, and effectively discharging the toner from the toner discharge aperture to the exterior of the container.

The edge of the baffle plate 3 in the vicinity of the toner discharge aperture 7 is positioned inside the toner discharge aperture 7 when seen from the flange portion side with respect to the rocking axis of the container, and is preferably in a position to laterally bisect the discharge aperture 7.

The aforementioned baffle plate 3 and the internal surface of the tubular portion of the container main body 1 are maintained in a mutually non-contacting state in order to avoid generation of the coarse toner particles in the course of rocking motion, but there is more preferred a configuration shown in FIGS. 9A and 9B in which a flexible sheet 14 composed for example of urethane rubber or polyester film is mounted on an edge of the baffle plate so as to be in contact with the internal surface of the tubular portion of the container main body, thereby reducing the remaining toner amount. In such case the coarse toner particles are not generated because of the use of the flexible sheet 14.

Also the baffle plate 3 is effectively provided with a window 15 as shown in FIG. 10, in order to reduce the torque required for disintegrating the toner at the rocking motion of the container main body 1, and such window provides an effect of balancing the amounts of toner on both sides of the baffle plate 3, since the toner can move through the window 15 within the container.

The baffle plate 3 can be composed of a resinous material such as polypropylene, polyethylene or polystyrene, or a metal such as stainless steel or spring steel plate, but is preferably formed by injection molding of a resinous material in consideration of the quality, cost and mass producibility.

The toner discharge aperture 7 can be sealed with an easy opening film or a slide shutter, having a packing member on a shutter.

[Assembling Method of Toner Container]

Figure 24:
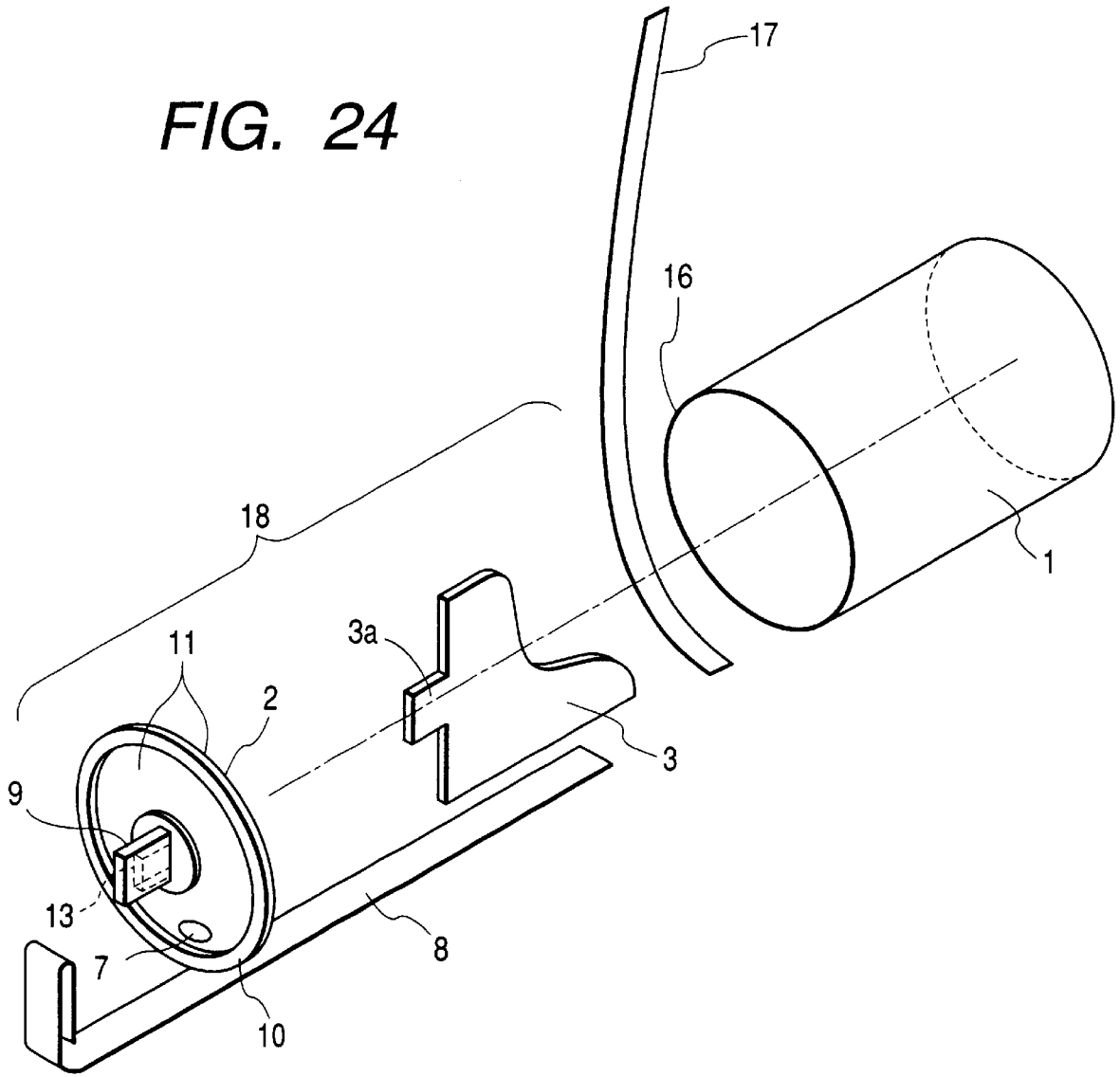
FIG. 24 is a schematic perspective view as to the assembling of the toner container of another embodiment.

The assembling method of the toner container will be explained with reference to FIG. 24.

The tubular container main body 1, the flange portion 2 (the non-extendable flange portion 11 and the extendable flange portion 10) and the baffle plate 3 are individually prepared for example by injection molding.

Then the non-extendable portion 11 and the extendable portion 10 are adhered.

The adhesion may be conducted in any method, such as thermal fusion, ultrasonic fusion or adhesion with a double-sided tape, as long as sufficient sealing is secured. In this embodiment the extendable portion 10 and the non-extendable portion 11 were prepared by two-color molding. Then the non-extendable portion 11 and the baffle plate 3 are adhered.

The fixation is achieved for example by lightly pressing into the baffle mounting portion 13 provided inside the fixing portion 9 of the non-extendable portion 11. Otherwise the non-extendable portion 11 and the baffle plate 3 may be integrally formed in advance.

On the other hand, the toner discharge aperture 7 formed in the non-extendable portion 11 is sealed by thermal fusion of an easy-open film 8. Otherwise there may be adhered a film having an adhesive layer.

Then an Auger-type toner feeding machine shown in FIGS. 12A and 12B is employed to fill the toner of a predetermined amount into the container main body 1 with the sealed toner discharge aperture 7. On the open end 16 of the container main body 1 filled with the toner, the flange unit 18 on which the baffle plate 3 is mounted in advance is placed and is adhered to the container main body 1 in such a manner that the toner does not leak. The adhesion can be achieved by applying an adhesive tape 17 for example of polypropylene. There may also be employed other methods such as ultrasonic fusion or hot melting, but the adhesive tape application is preferred in consideration of the recycling property.

Instead of the above-described assembling method, there may be adopted a method of forming a toner filling aperture, different from the aperture of the container main body 1, for example on the bottom face thereof (opposed to the flange portion). In such case, after the container main body 1 and the flange unit 18 arc adhered as explained in the foregoing, the toner of the predetermined amount may be filled from such toner filling aperture, which may thereafter be closed with a sealing member such as a cap.

In the following there will be explained the toner replenishing operation with the toner container 0 (cf. FIGS. 23A and 23B) of the aforementioned configuration.

Figure 25A:
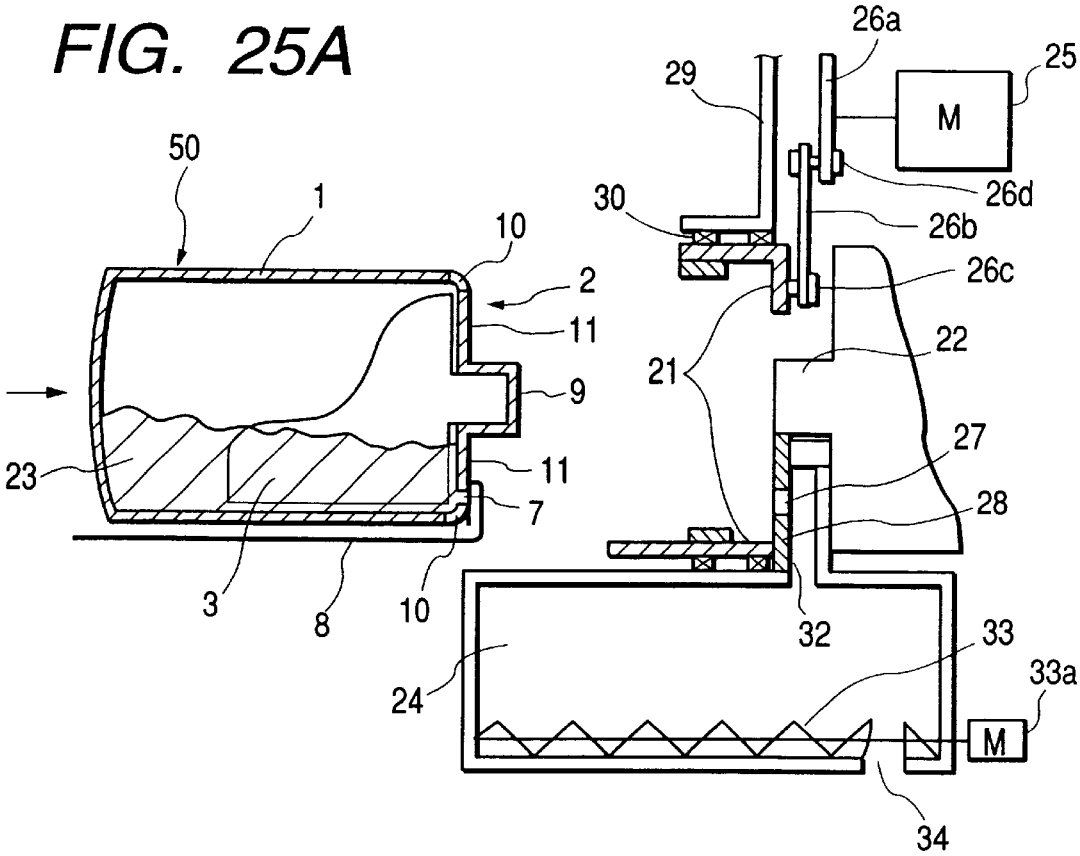
FIGS. 25A and 25B are schematic views showing the toner replenishing device of another embodiment, respectively before and after the mounting of the toner container.
Figure 25B:
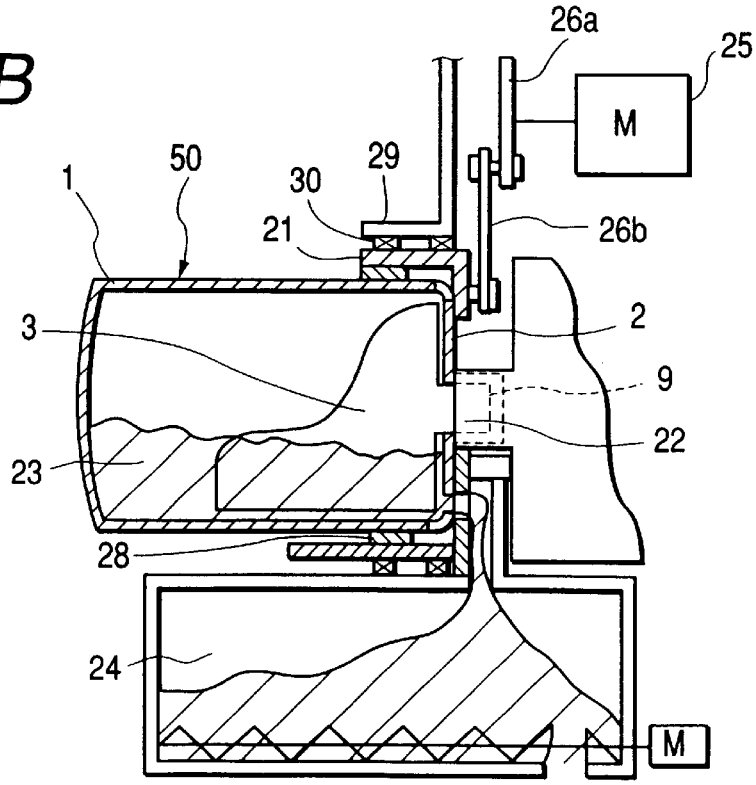

FIGS. 25A and 25B are schematic views of a toner replenishing unit.

In the toner replenishing unit, a drive unit 21 having a cylindrical external periphery in which the toner container 50 is fitted for rocking the toner container 50 engages with a locking unit 22 for fixing the fixing portion 9 of the flange portion 2 of the toner container 50 to maintain a fixed state against the reciprocating rocking motion of the container main body 1, in order to engage the discharge aperture 7 with a toner receiving aperture 27 of the toner replenishing unit. Also, the toner replenishing unit is provided with a developing buffer 24 for discharging the toner 23 contained in the toner container 50 through the discharge aperture 7 to the developing unit.

Referring to FIGS. 25A and 25B, a link rod 26*b*, positioned substantially perpendicular to the plane of the drawing, is connected with the drive unit 21 by a pin 26*c* and executes a rocking motion between the tangential lines of a circle passing through the pin 26*c*, around the rotary center of the drive unit 21.

In the drive unit 21, a motor 25 rotates to cause a reciprocating rocking motion of the link rod 26*b*, which is linked at an end thereof by a pin 26*d* to a crank disk 26*a* fixed to the shaft of the motor 25, whereby the drive unit 21 executes a reciprocating rocking motion with an angle and a reciprocating speed defined by the rotation speed of the motor 25 and the length of the link rod 26*b*. The drive unit 21 is also provided with a toner receiving aperture 27 in a position engaging with the discharge aperture 7 of the toner container 50, and such aperture is surrounded by an elastic member to seal the toner. Also on the external surface of the drive unit 21, there is provided a drive guide unit 29, and a sliding member 30 is provided between the drive unit 21 and the drive guide unit 29/developing buffer 24.

The developing buffer 24 is provided with a toner supply aperture 32, a carrying screw 33 and a toner discharge aperture 34.

Referring to FIG. 25A, the toner container 50 is pushed in a direction indicated by an arrow, and is set in the drive unit 21 of the toner replenishing unit.

Then the easy-open film 8 is peeled off to open the discharge aperture 7, as shown in FIG. 25B.

In the state shown in FIG. 25B, the fixing portion 9 of the toner container 50 engages with the locking unit 22, thereby maintaining the toner discharge aperture 7 and the baffle plate 3 in a fixed position against the rocking motion of the container main body 1. A part of the external periphery of the container main body 1 engages with the drive unit 21 whereby the toner container 50 is rendered capable of rocking motion by the rocking force of the drive unit 21.

Figure 26A:
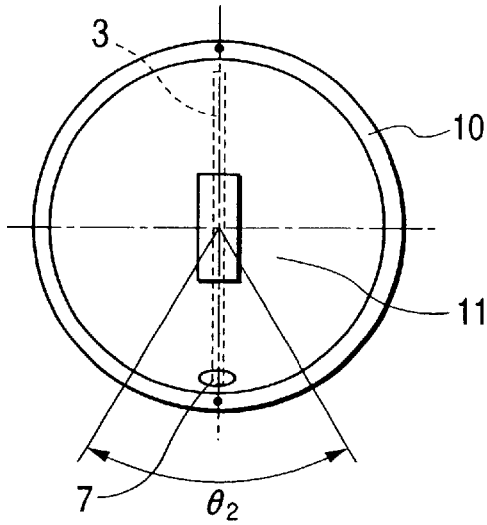
FIGS. 26A, 26B and 26C are elevation views showing the function of the flange portion in another embodiment.
Figure 26B:
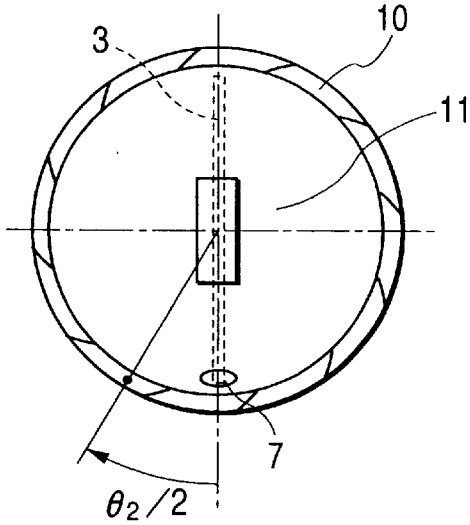
Figure 26C:
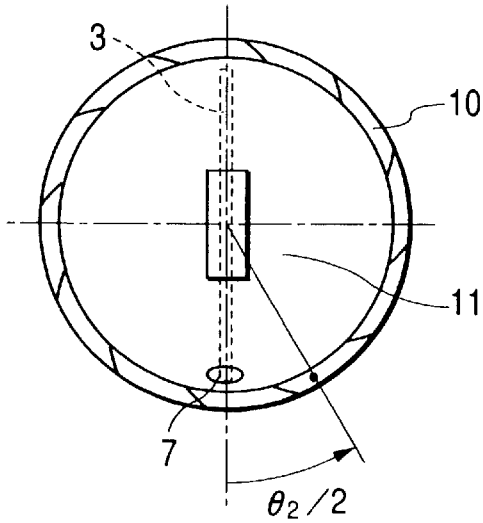

FIGS. 26A to 26C show the states of the flange portion 2 while the toner container 50 executes the rocking motion.

FIG. 26A shows a state at the setting of the toner container 50 on the toner replenishing unit, seen from the flange portion side thereof, wherein the edge portion of the baffle plate 3 at the side of the discharge aperture 7 is so positioned as to laterally bisect the discharge aperture 7 at the substantial center thereof. The toner discharge aperture 7 is positioned below the axis of the container, and the extendable portion 10 is not subjected to the stress in the rocking motion.

FIG. 26B shows a state in which the toner container 50 is moved by a rocking angle $\theta_2/2$ by the function of the drive unit 21. The container main body 1 is displaced by $\theta_2/2$ from the axis of the rocking motion, while the discharge aperture 7 remains fixed regardless of the above-mentioned movement. By the rotation of the container main body 1 by $\theta_2/2$, the extendable portion 10 is extended in a twisting direction.

Then the container main body 1 rocks in the opposite direction to assume again the state shown in FIG. 26A and then to a state shown in FIG. 26C by a further movement by $\theta_2/2$. The extendable portion 10 assumes an extended state, twisted in the opposite direction. The discharge aperture 7 naturally assumes a same position constantly.

By the rocking motion, repeating the states in the order of FIGS. 26A, 26B, 26A, 26C and 26A, the toner 23 in the toner container 50 is conveyed by a toner sweeping operation of the baffle plate 3 more effectively than in the foregoing embodiment toward the discharge aperture 7 and is discharged to the developing buffer 24.

In the following there will be explained the result of a discharge test of the present embodiment.

A toner container 50 having an internal diameter of 80 mm and an internal volume 500 cc (500 $cm^3$) was filled with 300 g of one-component magnetic toner, and, after vertical tapping 1000 times from a height of 2 cm, it was set on the above-described toner replenishing unit and subjected to the reciprocating cycles within a range of 30 to 300 times/minute and within an angular range of 30° ($\pi/6$ rad) to 180° ($\pi$ rad). In any of these conditions, the toner discharge was satisfactory, and was started from immediately after the start of the reciprocating rocking motion, with the remaining toner amount as low as 2 to 5 g.

As explained in the foregoing, in the present embodiment, at least a part of the flange portion provided at an end face of the toner container is formed extendable against the rocking motion of the container main body while the toner discharge aperture is provided in the non-extendable portion of the above-mentioned flange portion and a baffle plate is extended toward the interior of the toner container from the non-extendable portion of the above-mentioned flange portion, and there is employed a toner replenishing unit capable of causing rocking motion of such toner container, while maintaining the non-extendable portion in the fixed state, whereby the toner can be discharged without any difficulty even in case the toner is cohered and solidified in the distribution or transportation.

What is claimed is:

1. A toner container for containing toner and adapted to be detachably mountable on a toner receiving device for receiving the toner from said toner container, said toner container comprising:

a container main body portion;

a container end portion;

an aperture portion; and an extendable portion connecting said container main body portion and said container end portion;

wherein said container main body portion and said container end portion are driven to have a relative rocking motion by a driving means provided in the toner receiving device, and wherein the toner is discharged from said aperture portion by the relative rocking motion of said container main body portion and said container end portion.

2. A toner container according to claim 1, wherein said container end portion and said extendable portion are provided on a flange portion of said toner container.

3. A toner container according to claim 1, wherein said aperture portion is provided on said container main body portion.

4. A toner container according to claim 2, wherein said aperture portion is provided on said flange portion.

5. A toner container according to claim 1, further comprising a baffle portion in said container main body, wherein said baffle portion is capable of a rocking motion relative to said container main body portion.

6. A toner container according to claim 1, wherein said container end portion includes a fixing portion to be fixed by said toner receiving device when said toner container is mounted on said toner receiving device.

7. A toner container according to claim 5, wherein said container end portion includes a fixing portion to be fixed by said toner receiving device in such a manner that said container end portion and said baffle portion become immobile when said toner container is mounted on said toner receiving device.

8. A toner container according to claim 6, wherein said container end portion includes said aperture portion.

9. A toner container according to claim 7, wherein said container end portion includes said aperture portion.

10. A toner container for containing toner and adapted to be detachably mountable on a toner receiving device for receiving the toner from said toner container, said toner container comprising:

a container main body portion;

an aperture portion;

a baffle portion provided in an interior of said container main body portion; and a fixing portion to be fixed by said toner receiving device in such a manner that said baffle portion becomes immobile when said toner container is mounted on said toner receiving device, wherein, when said toner container is mounted on said toner receiving device, said container main body portion is driven to have a rocking motion relative to said baffle portion by a driving means provided in the toner receiving device and the toner is discharged from said aperture portion by the rocking motion of said container main body portion.

11. A toner container according to claim 10, wherein said fixing portion is provided at a container end portion of said toner container.

12. A toner container according to claim 11, wherein said container end portion is provided on a flange portion of said toner container.

13. A toner container according to claim 11, wherein said aperture portion is provided on said container end portion.

14. A toner container according to claim 11, wherein said container end portion includes said aperture portion.

15. A toner replenishing mechanism comprising:

a toner container for containing toner, including:

a container main body portion;

a container end portion;

an aperture portion;

an extendable portion connecting said container main body portion and said container end portion so that said container main body portion is capable of a rocking motion relative to said container end portion; and a toner receiving device on which said toner container is detachably mountable and which is adapted to receive the toner from said toner container, including:

a fixing portion for fixing said container end portion; and drive means for causing the rocking motion of said container main body, and adapted to rock said container main body portion to discharge the toner from said aperture portion.

16. A toner replenishing mechanism according to claim 15, wherein said toner container includes a baffle portion in said container main body, and said baffle portion is immobile while said drive means causes the rocking motion of said container main body.

17. A toner replenishing mechanism according to claim 15 or 16, wherein said aperture portion is provided in said container end portion, and said aperture portion is immobile while said drive means causes the rocking motion of said container main body portion.

18. A toner replenishing mechanism comprising:

a toner container for containing toner, including:

a container main body portion;

an aperture portion;

a baffle portion provided in an interior of said container main body portion; and a baffle fixing portion; and a toner receiving device on which said toner container is detachably mountable and which is adapted to receive the toner from said toner container, including:

a fixing unit for fixing said fixing portion such that said baffle portion becomes immobile while said toner is mounted on said toner receiving device; and drive means for causing a rocking motion of said container main body portion relative to said baffle portion when said fixing portion is fixed by said fixing unit, and adapted to rock said container main body portion to discharge the toner from said aperture portion.

19. A toner replenishing mechanism according to claim 18, wherein said aperture portion is provided on the container end portion of said toner container, and said aperture portion is immobile while said drive means causes the rocking motion of said container main body portion.

20. A toner container according to claim 1 or 10, wherein said rocking motion is a reciprocating rotation of said container main body.

21. A toner container according to claim 20, wherein a centerline of said reciprocating rotation is substantially parallel with a horizontal line.

22. A toner replenishing mechanism according to claim 15 or 18, wherein said rocking motion is a reciprocating rotation of said container main body.

23. A toner replenishing mechanism according to claim 22, wherein a centerline of said reciprocating rotation is substantially parallel with a horizontal line.

* * * * *

UNITED STATES PATENT AND TRADEMARK OFFICE

CERTIFICATE OF CORRECTION

PATENT NO. : 6,314,261 B1
DATED : November 6, 2001
INVENTOR(S) : Kazuhiko Omata et al.

It is certified that error appears in the above-identified patent and that said Letters Patent is hereby corrected as shown below:

Title page,
Item [56], References Cited, insert:
-- 07-020705 1/24/95 Japan
10-260574 9/29/98 Japan --.

Column 5,
Line 39, "01" should read -- $\theta_1$ --.

Column 6,
Line 32, "f or" should read -- for --;
Line 57, "such" should read -- such a --; and
Line 63, "following" should read -- following, --.

Column 8,
Line 23, "following" should read -- following, --; and
Line 36, "following" should read -- following, --.

Column 10,
Line 20, "following" should read -- following, --; and
Line 31, "Further" should read -- Further, --.

Column 11,
Line 30, "following" should read -- following, --; and
Line 52, "following" should read -- following, --.

Column 13,
Line 22, "Also" should read -- Also, --.

Column 14,
Line 13, "such" should read -- such a --; and
Line 18, "following" should read -- following, --.

Column 15,
Line 33, "following" should read -- following, --.

UNITED STATES PATENT AND TRADEMARK OFFICE

CERTIFICATE OF CORRECTION

PATENT NO. : 6,314,261 B1
DATED : November 6, 2001
INVENTOR(S) : Kazuhiko Omata et al.

It is certified that error appears in the above-identified patent and that said Letters Patent is hereby corrected as shown below:

Column 18,
Line 2, "and" should be deleted.

Signed and Sealed this

Thirteenth Day of August, 2002

*Attest:*

*Attesting Officer*

JAMES E. ROGAN
*Director of the United States Patent and Trademark Office*